US006762542B2

(12) United States Patent
Nukanobu et al.

(10) Patent No.: US 6,762,542 B2
(45) Date of Patent: Jul. 13, 2004

(54) ELECTRON SOURCE AND IMAGE DISPLAY DEVICE

(75) Inventors: Kouki Nukanobu, Kanagawa (JP); Takashi Enomoto, Kanagawa (JP); Keishi Danjo, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/842,678

(22) Filed: Apr. 27, 2001

(65) Prior Publication Data

US 2002/0017849 A1 Feb. 14, 2002

(30) Foreign Application Priority Data

May 8, 2000 (JP) ..... 2000-134823

(51) Int. Cl.[7] ..... H01J 1/02

(52) U.S. Cl. ..... 313/310; 313/306; 313/308; 313/309; 313/336; 313/351; 313/495; 313/496

(58) Field of Search ..... 313/310, 495, 313/496, 306, 309, 308, 336, 351; 315/169.3

(56) References Cited

U.S. PATENT DOCUMENTS 5,831,387 A * 11/1998 Kaneko et al. ..... 313/310
6,144,154 A * 11/2000 Yamazaki et al. ..... 313/292
6,144,166 A * 11/2000 Nakamura et al. ..... 313/306
6,329,750 B1 * 12/2001 Hofmann et al. ..... 313/292
6,635,984 B1 * 10/2003 Shibata ..... 313/495

* cited by examiner

*Primary Examiner*—David Zarneke
*Assistant Examiner*—Thanh Y. Tran
(74) *Attorney, Agent, or Firm*—Fitzpatrick, Cella, Harper & Scinto

(57) ABSTRACT

An electron source includes a substrate, a coating layer provided on the substrate, plural electron emission elements disposed on the coating layer, and a metal for connecting the plural electron emission elements. The electron emission element includes a conductive film including the electron emission part disposed on the coating layer, with the conductive film being connected to a wiring line with a conductive member for blocking the metals contained in the wiring lines from being transferred to the conductive film.

12 Claims, 13 Drawing Sheets

ELECTRON SOURCE AND IMAGE DISPLAY DEVICE

BACKGROUND OF THE INVENTION

1. Field of the Invention

The present invention relates to an electron source and an image forming device using the electron source.

2. Description of the Related Art

Thin and planar image forming devices have been actively developed as display devices due to their efficient use of installation spaces. For example, a liquid crystal display device has been popularly used for a display member of portable type personal computers. However, the liquid crystal display device has the problems of dark image, difficulty of making the panel size large, and narrow angle of vision. Consequently, a spontaneous light emission type display has been noticed. The spontaneous light emission display using a plasma display and an electron emission element is more luminous and has a wider angle of vision as compared with the liquid crystal display.

The electron emission element is mainly divided into two categories of a thermionic emission element and cold emission element. The cold emission element include field emission type (abbreviated as a FE type hereinafter), metal/insulation layer/metal type (abbreviated as a MIM type hereinafter) and surface conduction type electron emission elements. Examples of the FE type elements include those disclosed in P. Dyke & W. W. Dolan "Field Emission", Advance in Electron Physics, 8, 89 (1956) and C. A. Spindt, "Physical Properties of Thin-film Field Emission Cathode with Molybdenum Cones", J. Appl. Phys., 47, 5248 (1976). Examples of the MIM type elements include those disclosed in A. Mead, "Operation of Tunnel-Emission Devices", J. Aply. Phys., 32, 646 (1961).

Examples of the surface conduction type electron emission elements include those disclosed in M. I. Elinson, Radio Eng. Electron Phys., 10, 1290 (1965). The surface conduction type electron emission element takes advantage of a phenomenon by which electrons are emitted by flowing an electric current in parallel to the film surface formed as a small area thin film on a substrate. These surface conduction type electron emission elements include those using a $SnO_2$ thin film reported by Elinson et. al., using an Au thin film [G. Dittmer, "Thin Solid Films", 9, 317 (1972)], using an $In_2O_3/SnO_2$ thin film [M. Hartwell and C. G. Fonstad, "IEEE Trans. ED Conf.", 519, (1975)], and using a carbon thin film [Hisashi Araki, "Sinku (Vacuum)", vol. 26, No. 1, p22 (1983)].

FIGS. 13A and 13B show one example of the surface conduction type electron emission element. FIG. 13A is a plane view and FIG. 13B is a cross section. The reference numeral 6 denotes an insulation substrate, the reference numerals 2 and 3 denote element electrodes for attaining electrical connection, the reference numeral 4 denotes a conductive film, and the reference numeral 5 denotes an electron emission part. FIG. 8 shows a schematic drawing of one example of the image forming device using an electron source formed by aligning the surface conduction type electron emission elements in a matrix.

The construction of the element shown in FIGS. 13A and 13B is a construction of a unit element, and a number of these unit elements 76 are aligned on the substrate (a rear plate) 81 corresponding to pixels, thereby forming an electron source in the image forming device shown in FIG. 8.

Wiring lines 72 in the X-direction and wiring lines 73 in the Y-direction are formed on the substrate 81 by being separated by an insulation layer (not shown) forming a matrix of the wiring lines in order to arbitrarily select each element. A glass plate is often used for the substrate 81.

The reference numeral 88 denotes an external case and the reference numeral 86 denotes face plates in the image forming device shown in FIG. 8. Bonding portions among the external case 88, rear plate 81 and face plates 86 are bonded (sealed) with a binder such as a low melting point glass frit (not shown) to constitute an airtight vessel for evacuating the inside of the image forming device. The vessel is usually sealed by fusion of the frit glass. The heating temperature is typically about 400 to 500° C., and the heating time is typically 10 minutes to 1 hour, although it differs depending on the size of the external case 88.

A blue sheet glass is preferably used as the material of the external case 88 because it can be easily and certainly fused with the frit and because it is relatively cheap. A high distortion point glass having a high distortion point prepared by substituting a part of Na with K may be preferably used since it is also readily fused with the frit. The blue sheet glass or the high distortion point glass may be also preferably used for the substrate 81 since these materials can be certainly fused with the external case 88.

A fluorescent film 84 made of a fluorescent substance is formed on the lower face of the face plate 86. A metal back 85 made of, for example, Al is formed on the rear plate side surface of the fluorescent film 84. The fluorescent film is divided into three portions coated with three kinds of fluorescent substances (not shown) having primary colors of red (R), green (G) and blue (B), respectively. The colored fluorescence films forming the fluorescence film 84 are separated with black films (not shown).

The inside of the airtight vessel is evacuated at a pressure of as low as $10^{-4}$ Pa or below. The distance between the rear plate 81 on which the electron emission elements are formed and the face plate 86 on which the fluorescent film 84 is formed is usually maintained at several hundreds micrometers to several hundreds millimeters.

The image forming device as hitherto described is addressed by applying a voltage to each electron emission element 76 through terminals Doxl to Doxm and Doyl to Doym at the outside of the vessel, and the wiring lines 72 and 73 to emit electrons from each element 76. A high voltage is simultaneously applied to the metal back 85 through a terminal Hv at the outside of the vessel, thereby accelerating the emitted electrons from each element 76 and allowing the electrons to collide with each corresponding fluorescent substance. The fluorescent substance is excited and emits a light by collision of the electrons.

While the substrate of the electron source (rear plate) having the wiring matrix on it described above may be formed by various methods, all the element electrodes and wiring lines can be manufactured by a photolithographic method.

Printing methods such as a screen printing and offset printing may be diverted for manufacturing the substrate for the electron source. The printing methods are suitable for forming a pattern of a large area screen, and are preferable for facilitating to align a number of the electron emission elements on the substrate. For example, Japanese Patent Laid-Open Nos. 08-185818, 08-034110, 08-236017 and 09-283061 disclose a method for manufacturing the rear plate by the printing method, and a method for forming the wiring lines in the X-direction, interlayer insulation layer and wiring lines in the Y-direction by screen printing.

One example of the method for manufacturing the electron source substrate disclosed in the patent publications cited above is described with reference to FIGS. 14A to 14E. At first, a pair of the element electrodes 2 and 3 are formed on the rear plate 81 as a matrix (FIG. 14A). Then, n lines of the wiring lines 73 in the Y-direction are printed with a paste containing conductive material particles so that the electrodes 2 are commonly connected, and the printed wiring lines are fired (FIG. 14B). Subsequently, the insulation layer 74 is printed with a paste containing insulating particles (glass particles) into a comb teeth shape followed by firing (FIG. 14C). Then, a paste containing a conductive material is printed so that the wiring lines 72 in the X-direction is commonly connected 25 to the electrodes 3 on each insulation layer 74, followed by firing (FIG. 14D). A conductive film 4 is formed thereafter so as to connect the element electrode 2 to the element electrode 3 (FIG. 14E). Finally, a gap is formed at a part of the conductive film by flowing an electric current through the conductive film 4 to form an electron emission part 5.

Low resistance metals such as Al, Cu, Ag and Pt are favorable for allowing an image to uniformly display on the entire surface of a large area display screen that is currently expected in the market. Ag is in particular a preferable wiring material for printing the wiring lines since it is readily printed as a paste. While Pt is preferably used as the element electrode material since it is suitable for printing and has high heat resistance, the material cost is high.

When the unit element of the surface conduction type electron emission elements in the electron source as shown in FIGS. 13A and 13B is addressed for a long period of time, on the other hand, Na ions in the substrate are localized on the surface of the substrate due to the electric field, sometimes causing deterioration of the electron source characteristics. Deterioration of the electron source characteristics as used herein refers to a phenomenon by which the electric current flowing between the two electrodes (referred as an "element current" or "If") decreases as a function of the addressing time when a voltage is applied between a pair of the element electrodes of the surface conduction type electron emission elements. Decrease of the element current causes decrease of the electric current discharged in a vacuum (referred as "electron emission current" or "Ie"), and the image is gradually darkened in the image forming device using a fluorescent substance as an image forming member.

Deterioration of the electron source characteristics may be avoided in the unit element by blocking Na by forming a film by forming a film mainly comprising $SiO_2$ on the surface of the glass substrate containing Na.

However, metal ions, for example Ag ions when the wiring material is Ag, diffuse from the wiring material into the uppermost layer formed for blocking Na as described above, or into the layer formed for suppressing electrification of the uppermost layer of the substrate in some cases, at the temperature for bonding the glass frit when the image display device is evacuated, or by the heat when the image display device is addressed. As a result, Na ions tend to readily diffuse from the substrate into the electron emission part, or the metal ions themselves tend to readily diffuse into the electron emission part, thereby deteriorating the electron source characteristics.

SUMMARY OF THE INVENTION

Accordingly, it is an object of the present invention to provide a luminous and high quality image display device by suppressing the electron source characteristics from deteriorating by blocking metal ions from diffusing from the wiring lines at the bonding temperature of the glass frit when the image display device is evacuated, or by the heat generated during addressing the image display device.

The present invention provides an electron source comprising a substrate, an antistatic film formed on the substrate, plural electron emission elements disposed on the antistatic film, and wiring lines containing a metal for connecting the plural electron emission elements. The electron emission element comprises a conductive film including an electron emission part disposed on the antistatic film. The conductive film is connected to the wiring lines with a conductive member for blocking the metal contained in the wiring lines from being transferred to the conductive film.

The present invention also provides an electron source comprising a substrate, an antistatic film formed on the substrate, plural electron emission elements disposed on the antistatic film, and wiring lines containing a metal for connecting the plural electron emission elements. The electron emission element comprises a conductive film including an electron emission part disposed on the antistatic film. The conductive film is electrically connected to the wiring lines via a conductive member provided between the wiring lines and antistatic film for blocking the metal contained in the wiring lines from being transferred to the conductive film.

The present invention further provides an electron source comprising a substrate, an antistatic film formed on the substrate, plural electron emission elements disposed on the antistatic film, and wiring lines containing a metal for connecting the plural electron emission elements. The electron emission element comprises a pair of electrodes disposed on the antistatic film and a conductive film including an electron emission part disposed between and connected to a pair of the electrodes. The conductive film is connected to the wiring lines with a pair of the electrodes, and a pair of the electrodes is composed of a conductive member for blocking the metal contained in the wiring lines from being transferred to the conductive metal.

The present invention further provides an electron source comprising a substrate containing sodium, a sodium blocking film formed on the substrate, plural electron emission elements disposed on the sodium blocking film, and wiring lines containing a metal for connecting the plural electron emission elements. The electron emission element comprises a conductive film including an electron emission part disposed on the sodium blocking film. The conductive film is connected to the wiring lines with a conductive member for blocking the metal contained in the wiring lines from being transferred to the conductive film.

The present invention further provides an electron source comprising a substrate containing sodium, a sodium blocking film formed on the substrate, plural electron emission elements disposed on the sodium blocking film, and wiring lines containing a metal for connecting the plural electron emission elements. The electron emission element comprises a conductive film including an electron emission part disposed on the sodium blocking film. The conductive film is electrically connected to wiring lines via a conductive member provided between the wiring lines and the sodium blocking film for blocking the metal contained in the wiring lines from being transferred to the conductive film.

The present invention further provides an electron source comprising a substrate containing sodium, a sodium blocking film formed on the substrate, plural electron emission elements disposed on the sodium blocking film, and wiring lines containing a metal for connecting the plural electron emission elements. The electron emission element comprises a pair of electrodes disposed on the sodium blocking film and a conductive film including an electron emission part disposed between and connected to a pair of the electrodes. The conductive film is connected to the wiring lines with a pair of the electrodes, and a pair of the electrodes is composed of a conductive member for blocking the metal contained in the wiring lines from being transferred to the conductive film.

The present invention further provides an electron source comprising a substrate, a film of an insulation material provided on the substrate and containing a metal oxide, plural electron emission elements disposed on the film of an insulation material containing the metal oxide, and wiring lines containing a metal for connecting the plural electron emission elements. The electron emission element comprises a conductive film including an electron emission part disposed on the film of an insulation material containing the metal oxide. The conductive film is connected to the wiring lines with a conductive member for blocking the metal contained in the wiring lines from being transferred to the conductive film.

The present invention further provides an electron source comprising a substrate, a film of an insulation material provided on the substrate and containing a metal oxide, plural electron emission elements disposed on the film of an insulation material containing the metal oxide, and wiring lines containing a metal for connecting the plural electron emission elements. The electron emission element comprises a conductive film including an electron emission part disposed on the film of an insulation material containing the metal oxide. The conductive film is electrically connected to the wiring lines via a conductive member for blocking the metal contained in the wiring lines from being transferred to the conductive film provided between the film of an insulation material containing the metal oxide and the wiring lines.

The present invention further provides an electron source comprising a substrate, a film of an insulation material provided on the substrate and containing a metal oxide, plural electron emission elements disposed on the film of an insulation material containing the metal oxide, and wiring lines containing a metal for connecting the plural electron emission elements. The electron emission element comprises a conductive film including a pair of electrodes disposed on the film of an insulation material containing the metal oxide and an electron emission part disposed between and connected to a pair of the electrodes. The conductive film is connected to the wiring lines with a pair of the electrode, and a pair of the electrodes is composed of a conductive member for blocking the metal contained in the wiring lines from being transferred to the conductive film.

The present invention further provides an electron source comprising a substrate, a $SiO_2$ film provided on the substrate and containing a metal oxide, plural electron emission elements disposed on the $SiO_2$ film containing the metal oxide, and wiring lines for connecting the plural electron emission elements. The electron emission element comprises a conductive film containing an electron emission part disposed on the $SiO_2$ film containing the metal oxide. The conductive film is connected to the wiring lines with a member comprising $In_2O_3$—$SnO_2$ as a constituent.

The present invention further provides an electron source comprising a substrate, a $SiO_2$ film provided on the substrate and containing a metal oxide, plural electron emission elements disposed on the $SiO_2$ film containing the metal oxide, and wiring lines for connecting the plural electron emission elements. The electron emission element comprises a conductive film containing an electron emission part disposed on the $SiO_2$ film containing the metal oxide. The conductive film is electrically connected to the wiring lines via a member comprising $In_2O_3$—$SnO_2$ as a constituent provided between the $SiO_2$ film containing the metal oxide and the wiring lines.

The present invention further provides an electron source comprising a substrate, a $SiO_2$ film provided on the substrate and containing a metal oxide, plural electron emission elements disposed on the $SiO_2$ film containing the metal oxide, and wiring lines for connecting the plural electron emission elements. The electron emission element comprises a pair of electrodes disposed on the $SiO_2$ film containing the metal oxide and a conductive film including an electron emission part disposed between and connected to a pair of the electrodes. The conductive film is connected to the wiring lines with a pair of the electrodes, and a pair of the electrodes comprises $In_2O_3$—$SnO_2$ as a constituent.

The present invention provides an image display device comprising an electron source and an image display member for displaying an image by electron irradiation from the electron sources. The electron source may be any one of the foregoing electron sources.

Further objects, featured and advantages of the present invention will become apparent from the following descriptions of the preferred embodiments with reference to the attached drawings.

DESCRIPTION OF THE PREFERRED EMBODIMENTS

Figure 1:
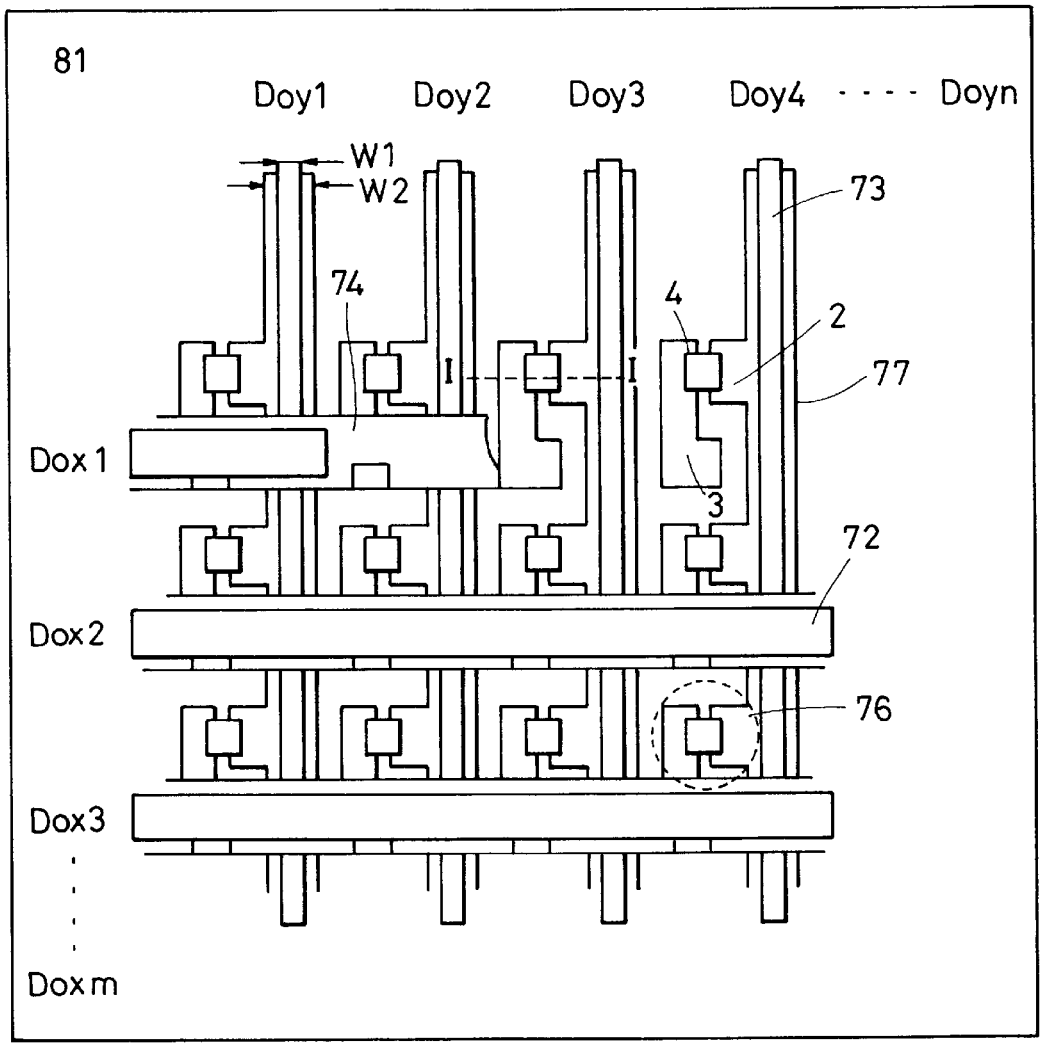
FIG. 1 is a schematic diagram showing an example of the electron source substrate according to the present invention.

The electron source according to the present invention comprises a substrate, an antistatic film formed on the substrate, plural electron emission elements disposed on the antistatic film, and wiring lines containing a metal for connecting the plural electron emission elements. The electron emission element comprises a conductive film including an electron emission part disposed on the antistatic film. The conductive film is connected to the wiring lines with a conductive member for blocking the metal contained in the wiring lines from being transferred to the conductive film.

The electron source also comprises a substrate, an antistatic film formed on the substrate, plural electron emission elements disposed on the antistatic film, and wiring lines containing a metal for connecting the plural electron emission elements. The electron emission element comprises a conductive film including an electron emission part disposed on the antistatic film. The conductive film is electrically connected to the wiring lines via a conductive member provided between the wiring lines and antistatic film for blocking the metal contained in the wiring lines from being transferred to the conductive film.

The electron source further comprises a substrate, an antistatic film formed on the substrate, plural electron emission elements disposed on the antistatic film, and wiring lines containing a metal for connecting the plural electron emission elements. The electron emission element comprises a pair of electrodes disposed on the antistatic film and a conductive film including an electron emission part disposed between and connected to a pair of the electrodes. The conductive film is connected to the wiring lines with a pair of the electrodes, and a pair of the electrodes is composed of a conductive member for blocking the metal contained in the wiring lines from being transferred to the conductive metal. Preferably, the conductive member for blocking the metal contained in the wiring lines from being transferred to the conductive film is further disposed between the wiring lines and the antistatic film.

The electron source further comprises a substrate containing sodium, a sodium blocking film formed on the substrate, plural electron emission elements disposed on the sodium blocking film, and wiring lines containing a metal for connecting the plural electron emission elements. The electron emission element comprises a conductive film including an electron emission part disposed on the sodium blocking film. The conductive film is connected to the wiring lines with a conductive member for blocking the metal contained in the wiring lines from being transferred to the conductive film.

The electron source further comprises a substrate containing sodium, a sodium blocking film formed on the substrate, plural electron emission elements disposed on the sodium blocking film, and wiring lines containing a metal for connecting the plural electron emission elements. The electron emission element comprises a conductive film including an electron emission part disposed on the sodium blocking film. The conductive film is electrically connected to wiring lines via a conductive member provided between the wiring lines and the sodium blocking film for blocking the metal contained in the wiring lines from being transferred to the conductive film.

The electron source further comprises a substrate containing sodium, a sodium blocking film formed on the substrate, plural electron emission elements disposed on the sodium blocking film, and wiring lines containing a metal for connecting the plural electron emission elements. The electron emission element comprises a pair of electrodes disposed on the sodium blocking film and a conductive film including an electron emission part disposed between and connected to a pair of the electrodes. The conductive film is connected to the wiring lines with a pair of the electrodes, and a pair of the electrodes is composed of a conductive member for blocking the metal contained in the wiring lines from being transferred to the conductive film. Preferably, the conductive member for blocking the metal contained in the wiring lines from being transferred to the conductive film is further disposed between the wiring lines and the sodium blocking film.

The electron source further comprises a substrate, a film of an insulation material provided on the substrate and containing a metal oxide, plural electron emission elements disposed on the film of an insulation material containing the metal oxide, and wiring lines containing a metal for connecting the plural electron emission elements. The electron emission element comprises a conductive film including an electron emission part disposed on the film of an insulation material containing the metal oxide. The conductive film is connected to the wiring lines with a conductive member for blocking the metal contained in the wiring lines from being transferred to the conductive film.

The electron source further comprises a substrate, a film of an insulation material provided on the substrate and containing a metal oxide, plural electron emission elements disposed on the film of an insulation material containing the metal oxide, and wiring lines containing a metal for connecting the plural electron emission elements. The electron emission element comprises a conductive film including an electron emission part disposed on the film of an insulation material containing the metal oxide. The conductive film is electrically connected to the wiring lines via a conductive member for blocking the metal contained in the wiring lines from being transferred to the conductive film provided between the film of an insulation material containing the metal oxide and the wiring lines.

The electron source further comprises a substrate, a film of an insulation material provided on the substrate and containing a metal oxide, plural electron emission elements disposed on the film of an insulation material containing the metal oxide, and wiring lines containing a metal for connecting the plural electron emission elements. The electron emission element comprises a pair of electrodes disposed on the film of an insulation material containing the metal oxide and a conductive film including an electron emission part disposed between and connected to a pair of the electrodes. The conductive film is connected to the wiring lines with a pair of the electrodes, and a pair of the electrodes is composed of a conductive member for blocking the metal contained in the wiring lines from being transferred to the conductive film. Preferably, the conductive member for blocking the metal contained in the wiring lines from being transferred to the conductive film is further disposed between the wiring lines and the film of an insulation material containing the metal oxide.

The electron source further comprises a substrate, a $SiO_2$ film provided on the substrate and containing a metal oxide, plural electron emission elements disposed on the $SiO_2$ film containing the metal oxide, and wiring lines for connecting the plural electron emission elements. The electron emission element comprises a conductive film containing an electron emission part disposed on the $SiO_2$ film containing the metal oxide. The conductive film is connected to the wiring lines with a member comprising $In_2O_3$—$SnO_2$ as a constituent.

The electron source further comprises a substrate, a $SiO_2$ film provided on the substrate and containing a metal oxide, plural electron emission elements disposed on the $SiO_2$ film containing the metal oxide, and wiring lines for connecting the plural electron emission elements. The electron emission element comprises a conductive film containing an electron emission part disposed on the $SiO_2$ film containing the metal oxide. The conductive film is electrically connected to the wiring lines via a member comprising $In_2O_3$—$SnO_2$ as a constituent provided between the $SiO_2$ film containing the metal oxide and the wiring lines.

The electron source further comprises a substrate, a $SiO_2$ film provided on the substrate and containing a metal oxide, plural electron emission elements disposed on the $SiO_2$ film containing the metal oxide, and wiring lines for connecting the plural electron emission elements. The electron emission element comprises a pair of the electrodes disposed on the $SiO_2$ film containing the metal oxide and a conductive film including an electron emission part disposed between and connected to a pair of electrodes. The conductive film is connected to the wiring lines with a pair of the electrodes, and a pair of the electrodes comprises $In_2O_3$—$SnO_2$ as a constituent. Preferably, a member comprising $In_2O_3$—$SnO_2$ as a constituent is further disposed between the wiring lines and the $SnO_2$ film containing the metal oxide.

The metal oxide is preferably an electron conductive oxide in the electron source according to the present invention.

The metal oxide is preferably an oxide of a metal selected from Fe, Ni, Cu, Pd, Ir, In, Sn, Sb and Re.

Preferably, a film comprising $SiO_2$ is further laminated on the $SiO_2$ film.

Preferably, the wiring lines comprises plural wiring lines in the column direction and plural wiring lines in the row direction. The plural electron emission elements are connected with the plural wiring lines in the column direction and plural wiring lines in the row direction to form a matrix.

The image display device according to the present invention preferably comprises an electron source and image display members for displaying an image by electron irradiation from the electron source. The electron source is any one of the electron sources described above.

Embodiments

Figure 9:
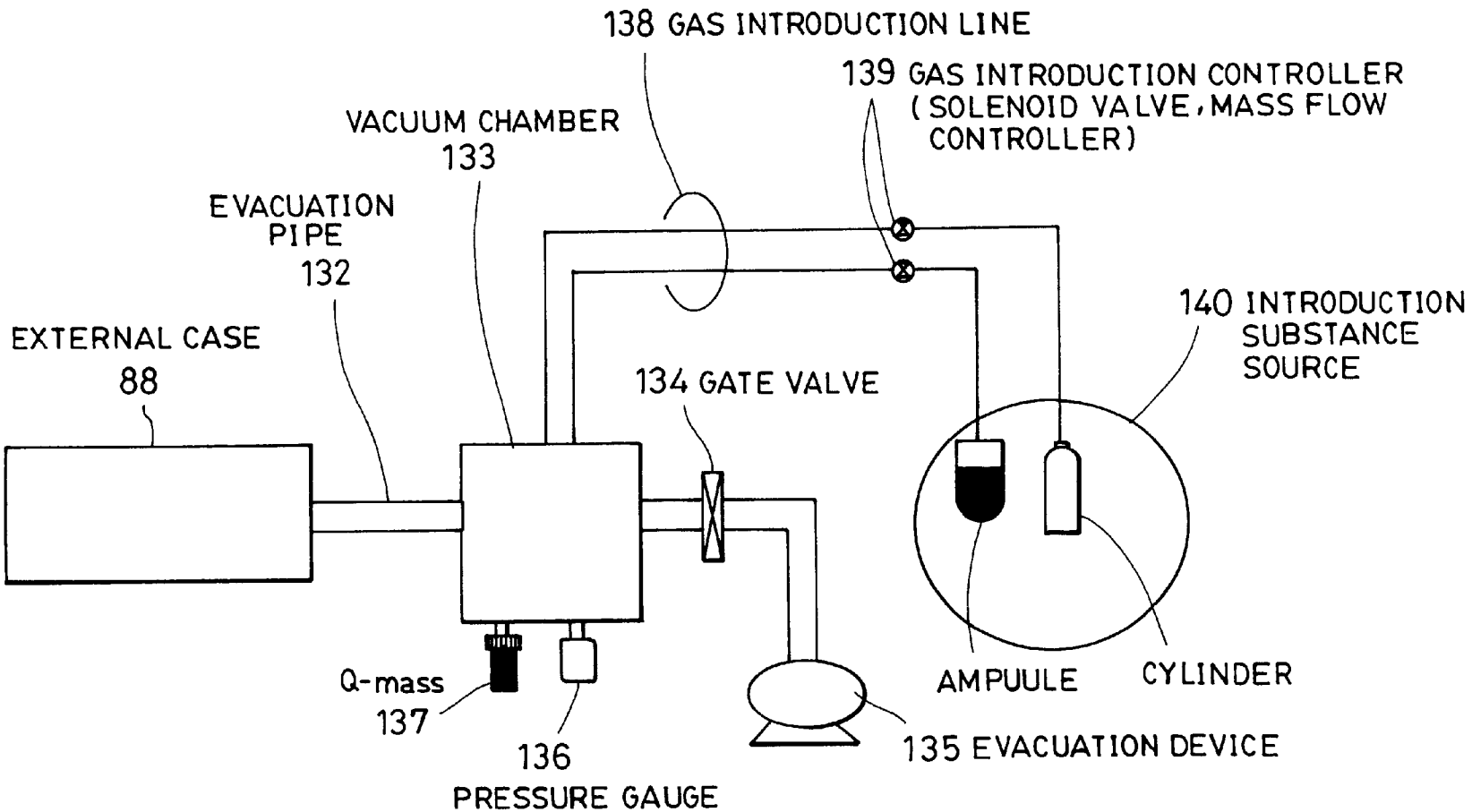
FIG. 9 illustrates a diagram showing an apparatus to be used for manufacturing the image display device.
Figure 11:
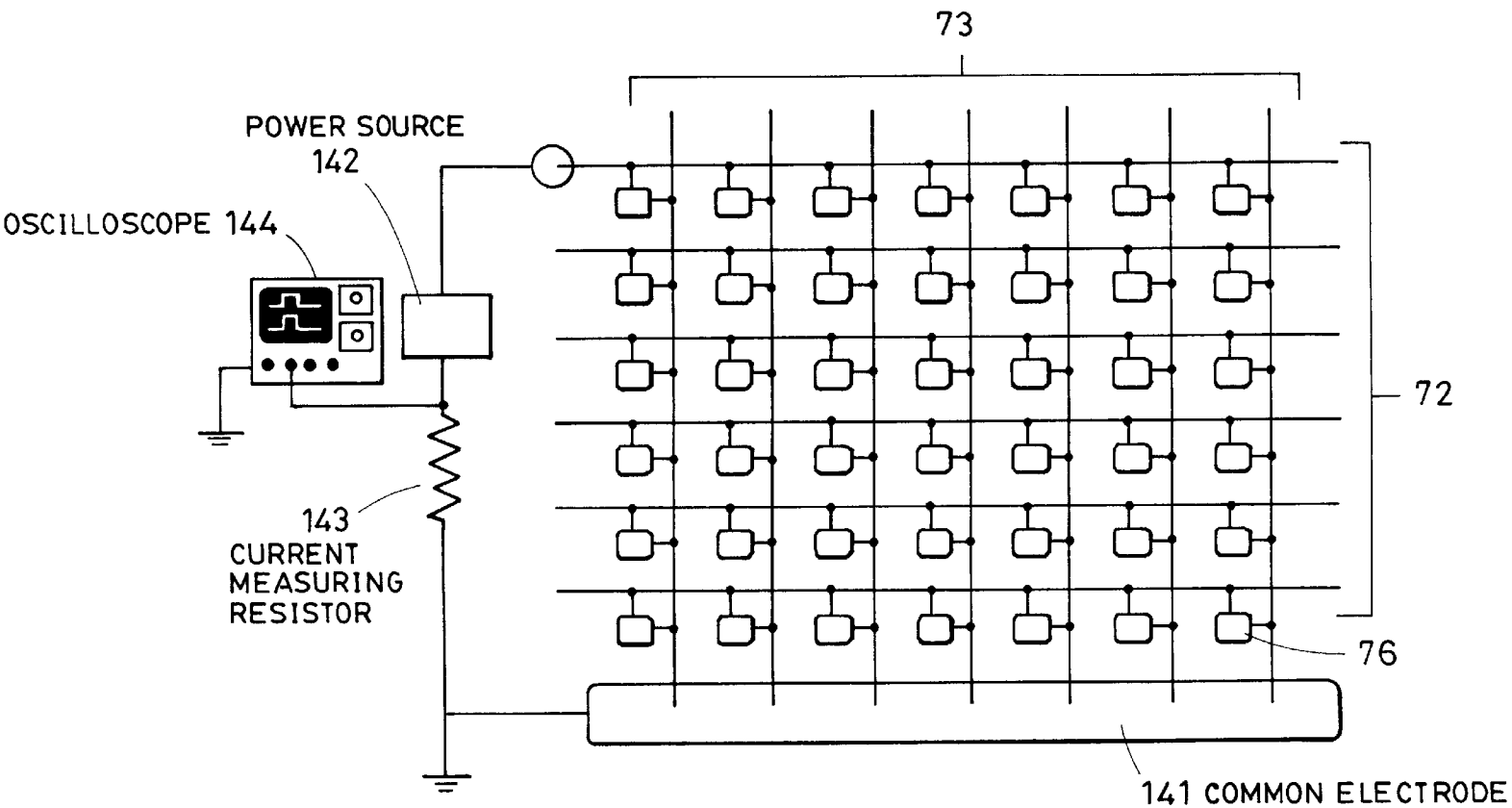
FIG. 11 illustrates the wiring method for the forming and activation steps of the image display device according to the present invention.
Figure 12:
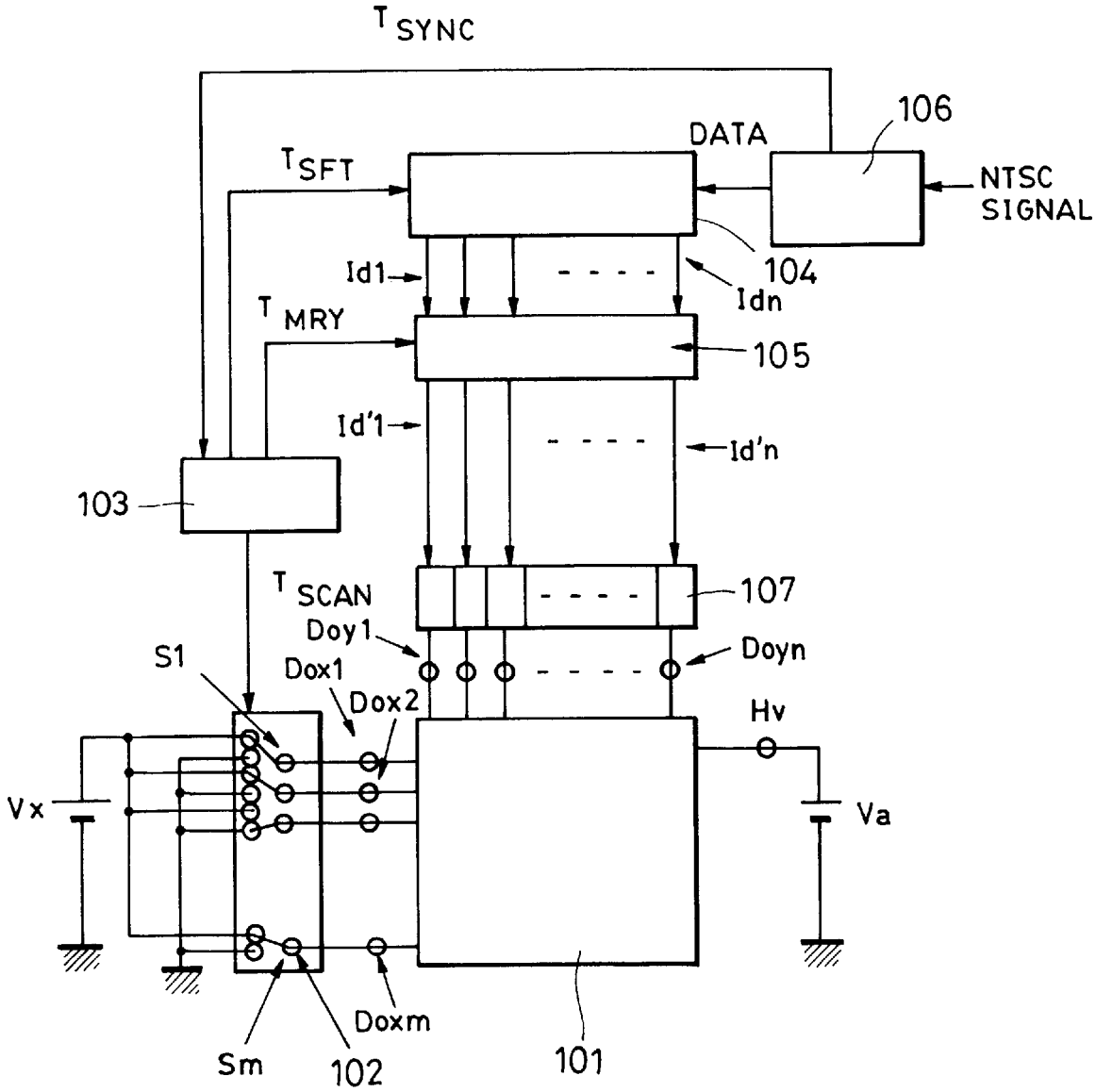
FIG. 12 is a block diagram showing an example of the addressing circuit.
Figure 13A:
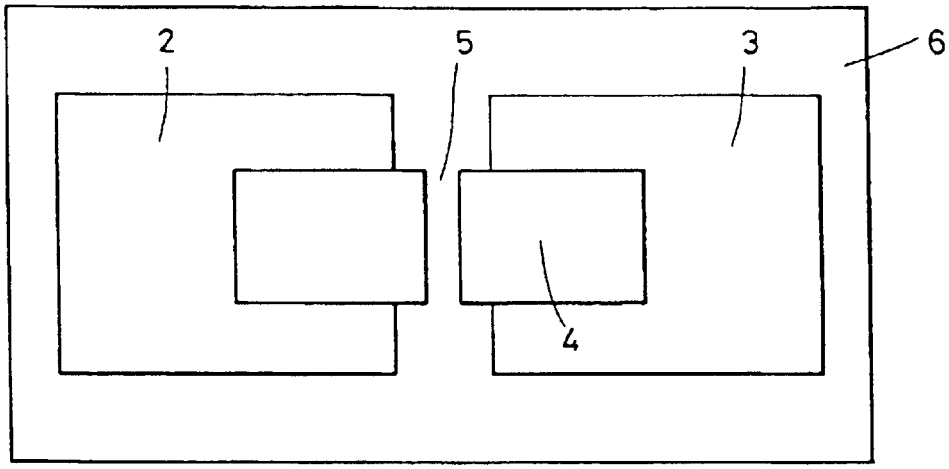
FIG. 13A PRIOR ART
FIG. 13A illustrates the plane view of an example of the surface conduction type electron emission element.
Figure 13B:
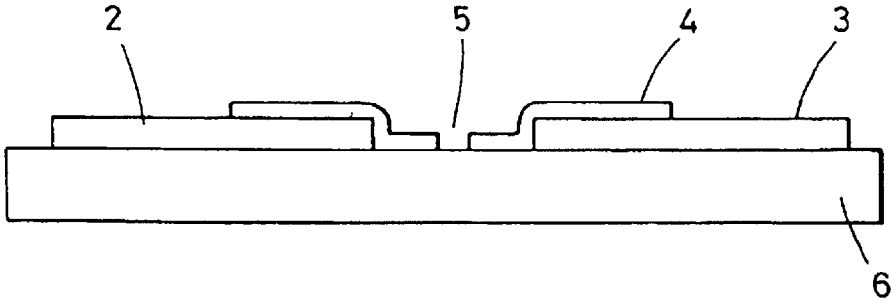
FIG. 13B PRIOR ART
FIG. 13B illustrates the cross section of an example of the surface conduction type electron emission element.
Figure 14A:
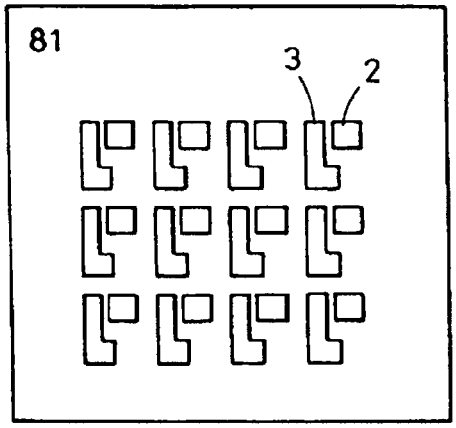
FIG. 14A PRIOR ART
FIG. 14A is an illustrative drawing describing a step for manufacturing the conventional electron source substrate.
Figure 14B:
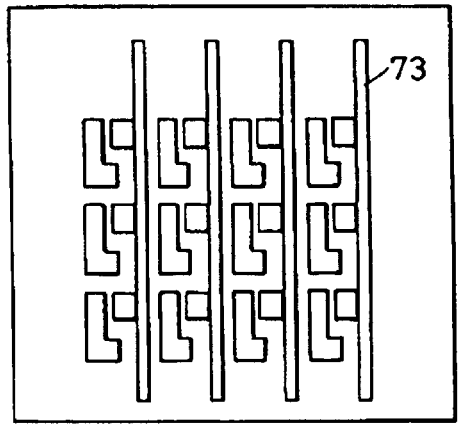
FIG. 14B PRIOR ART
FIG. 14B is an illustrative drawing describing a step for manufacturing the conventional electron source substrate.
Figure 14C:
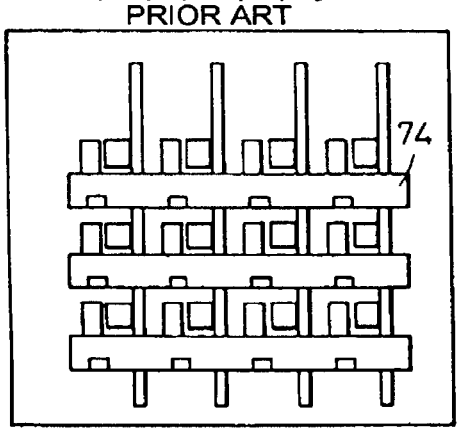
FIG 14C PRIOR ART
FIG. 14C is an illustrative drawing describing a step for manufacturing the conventional electron source substrate.
Figure 14D:
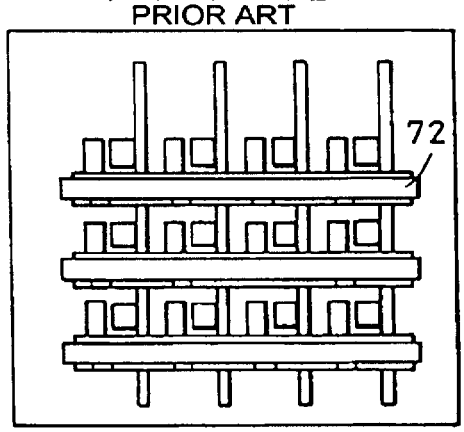
FIG. 14D PRIOR ART
FIG. 14D is an illustrative drawing describing a step for manufacturing the conventional electron source substrate.
Figure 14E:
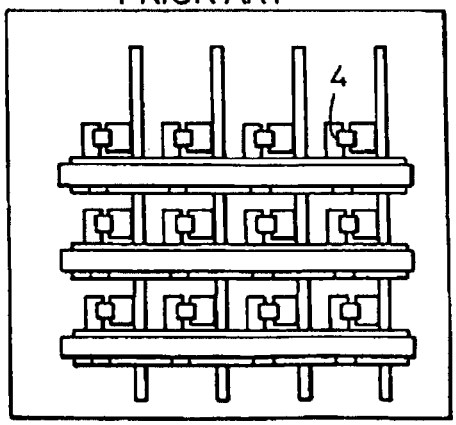
FIG. 14E PRIOR ART
FIG. 14E is an illustrative drawing describing a step for manufacturing the conventional electron source substrate.

The present invention will be described hereinafter in detail with reference to the drawings. Each of the elements shown in block outline in FIGS. 9, 11 and 12 is well-known per se, and a specific type of construction is not critical to carrying out the invention or to disclosure of the best mode for carrying out the invention.

Figure 2:
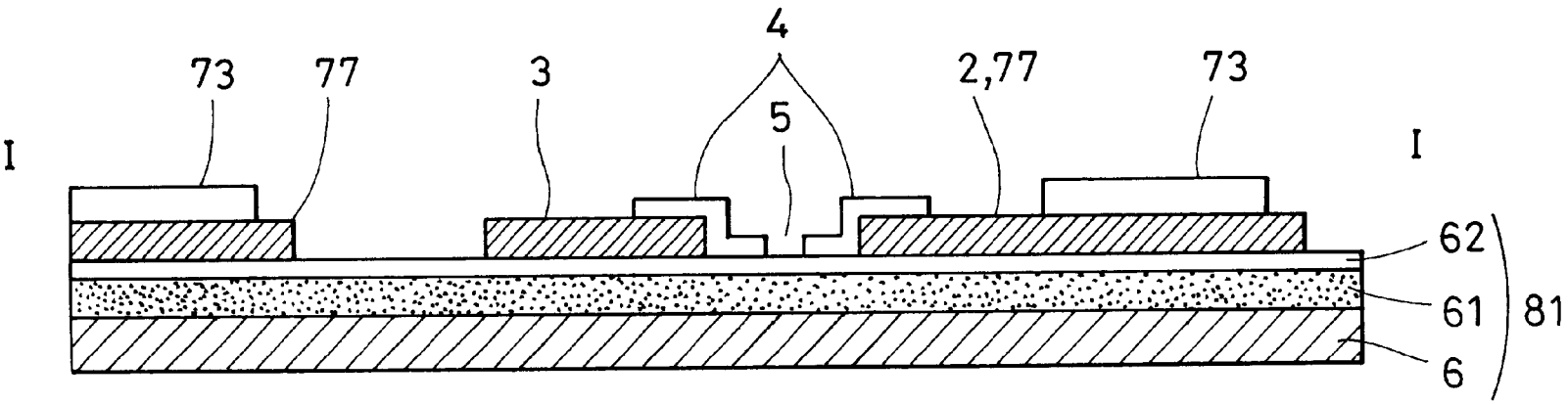
FIG. 2 is a cross section of the electron source substrate according to the present invention.

FIG. 1 shows an illustrative drawing showing an embodiment of the electron source substrate according to the present invention, and FIG. 2 is a cross section of the electron source substrate along the line I—I shown in FIG. 1.

A substrate 81 is composed of an insulation substrate 6, an antistatic film, a sodium blocking film, or a conductive oxide layer 61 comprising a film of an insulation material containing a metal oxide or a $SiO_2$ film containing the metal oxide, and a layer 62 mainly containing a $SiO_2$ film as a film comprising $SiO_2$.

The substrate 6 is a substrate containing Na such as a blue sheet glass or a high distortion point glass having a high distortion point prepared by substituting a part of Na with K.

The electron conductive oxide layer 61 disposed on the substrate 6 is a layer containing an electron conductive oxide as a metal oxide, and is provided for preventing electrification of the surface of the substrate on which the electron emission elements are formed. This enables stable electron emission characteristics to be obtained in the electron emission elements 76 disposed on the layer 62 mainly comprising $SiO_2$ to be described hereinafter by suppressing charge-up of the surface of the substrate. Although the film thickness of the electron conductive oxide layer 61 is not particularly restricted, it is particularly preferable for sufficiently exerting the effect described above that the sheet resistivity of the surface of the substrate is within the range of 108 $\Omega/m^2$ to 1013 $\Omega/m^2$. Diffusion of the Na ion from the substrate 6 can be suppressed to a certain extent since the conductive oxide layer is electron conductive. Examples of the electron conductive oxide include oxide particles comprising at least one element selected from Fe, Ni, Cu, Pd, Ir, In, Sn, Sb and Re. The electron conductive oxide layer is preferably a layer containing $SiO_2$ since the uppermost layer is a $SiO_2$ layer.

The layer 62 mainly comprising $SiO_2$ and disposed on the conductive oxide layer 61 is principally provided for blocking diffusion of Na to the member constituting the electron emission element, and preferably has a thickness of 50 nm or more for suppressing diffusion of Na, and for reducing roughness due to the oxide particles contained in the foregoing conductive oxide layer 61 on the surface of the substrate. It is in particular preferable that the thickness of the layer 62 mainly comprising $SiO_2$ is 300 nm or less for allowing the sheet resistivity of the surface of the substrate on which the electron emission elements are disposed to fall within the preferable range described above.

The electron emission elements 76 comprising the conductive film 4 including a pair of element electrodes 2 and 3, and an electron emission part 5 are formed as a matrix through first wiring lines (wiring lines in the Y-direction) and second wiring lines (wiring lines in the X-direction). A third layer 77 as a conductive member for blocking the metal contained in the wiring lines from being transferred to the conductive film 4 is provided between the first wiring lines 73 and the substrate 81, and the element electrodes 2 and 3. The third layer 77 is formed of the same material as will be described hereinafter.

The material of the first wiring lines 73 and the second wiring lines 72 is preferably a low resistance metal such as Al, Cu, Ag and Pt. Ag is a particularly preferable material since it is easily printed as a paste. $In_2O_3$—$SnO_2$ is the most preferable material from the point of preventing diffusion of Ag from the first wiring lines (Ag) into the substrate.

The surface conduction type electron emission element 76 will be described hereinafter.

A conventional conductive material may be used for the element electrodes 2 and 3 facing each other. The material can be selected from a metal such as Ni, Cr, Au, Mo, W, Pt, Ti, Al, Cu and Pd or an alloy thereof, a printed conductor comprising a metal or a metal oxide such as Pd, Ag, Au, $Ru_2O$ and Pd—Ag and a glass, or a transparent conductor such as $In_2O_3$—$SnO_2$, or a semiconductor material such as polysilicon. $In_2O_3$—$SnO_2$ as the same material of the third layer 77 was selected for the element electrodes in this embodiment considering the production cost, and the element electrodes were formed in the same step as will be described hereinafter.

The material of the conductive film 4 can be selected from metals such as Pd, Pt, Ru, Au, Ti, In, Cu, Cr, Fe, Zn, Sn, Ta, W and Pd, or oxides such as PdO, $SnO_2$, $In_2O_3$, PbO and $Sb_2O_3$. The conductive film 4 is preferably a fine particle film comprising plural fine particles having a particle diameter within the range of 1 nm to 20 nm in order to exhibit good electron discharge characteristics. The thickness of the conductive film 4 is preferably within the range of 1 nm to 50 nm.

The electron emission part (a gap) 5 is formed by generating a crack on the conductive film 4 formed between the element electrodes 2 and 3 by a forming treatment to be described hereinafter.

Figure 4A:
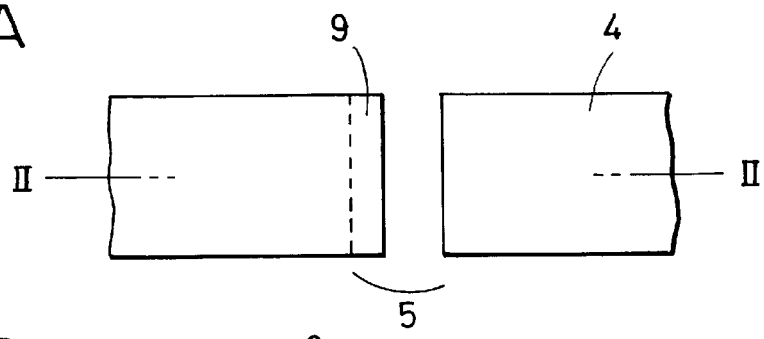
FIG. 4A is an illustrative enlarged partial plane view of the surface conduction type electron emission element to be used for the electron source according to the present invention.
Figure 4B:
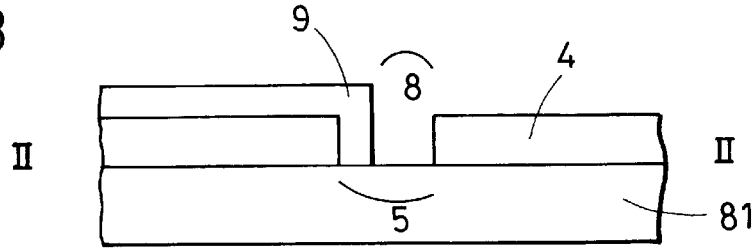
FIG. 4B is an illustrative enlarged partial cross section of the surface conduction type electron emission element to be used for the electron source according to the present invention.
Figure 5A:
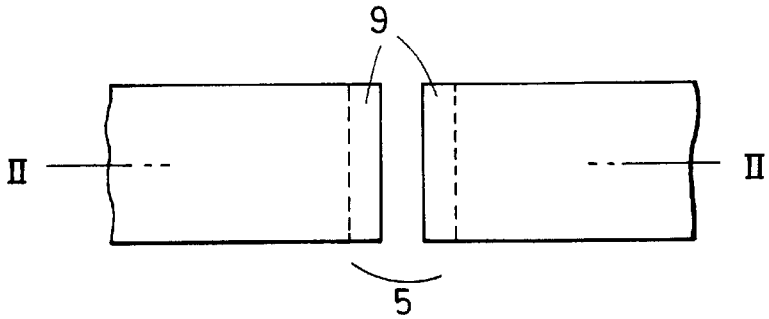
FIG. 5A is an illustrative enlarged partial plane view showing another example of the surface conduction type electron emission element to be used for the electron source according to the present invention.
Figure 5B:
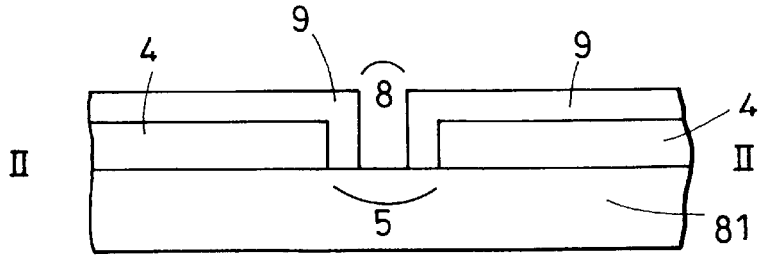
FIG. 5B is an illustrative enlarged partial cross section showing another example of the surface conduction type electron emission element to be used for the electron source according to the present invention.

A carbon film is preferably formed on the conductive film 4 for improving the electron emission characteristics and for reducing time-dependent changes of the electron emission characteristics. This carbon film is formed, for example, as shown in FIGS. 4A and 4B. FIG. 4A is an illustrative enlarged plane view of the conductive film of the surface conduction type electron emission element having the carbon film, and FIG. 4B is a cross section thereof along the line II—II. As shown in FIGS. 4A and 4B, the surface conduction type electron emission element having the carbon film is connected to the conductive film 4 so that a gap 8 narrower than a gap 5 formed between a pair of the conductive film 4 is formed, and the carbon film 9 is formed on the substrate 81 within the gap 5 and on the conductive film 4. A configuration having the carbon film 9 on both ends of the conductive film 4 facing the gap 5 will exert the same effect as described above as shown in FIGS. 5A and 5B.

An example of the method for manufacturing the electron source according to the present invention will be described below.

The method for manufacturing the electron source substrate 81 will be described at first.

A Na containing substrate 6 such as a blue sheet glass and high distortion pint glass is thoroughly washed using a detergent, pure water and an organic solvent to from a conductive oxide layer 61 on the substrate 6. A compound that can be converted into an electron conductive oxide layer, for example an oxide of at least one element selected from Fe, Ni, Cu, Pd, Ir, In, Sn, Sb and Re as hitherto described, may be used for the material of the conductive oxide layer 61. While a physical vacuum deposition method such as a sputtering method and vacuum deposition method may be used for forming the conductive oxide layer 61, a method for coating a dispersion of fine particles is preferably used. At first, particles of an electron conductive oxide described above are dispersed and coated on the substrate 6. The conductive oxide layer 61 containing $SiO_2$ can be formed by mixing a silicon compound in the dispersion solution.

Subsequently, a solution containing a silicon compound, for example an organic silicone, as a starting material of the layer 62 mainly comprising $SiO_2$ is coated on the substrate after allowing the dispersion solution to evaporate. Then, the coating film is heated in an oven together with the substrate to form the layer 62 mainly comprising the conductive oxide layer 61 and $SiO_2$. The surface of the conductive oxide layer 61 tends to be rough due to oxide particles contained in it. However, the surface of the electron source substrate 81 can be made to be relatively flat by forming the layer 62 mainly comprising $SiO_2$. Therefore, this method is preferably used for facilitating to form the electron emission element.

The electron source substrate 81 is manufactured as described above by laminating the conductive oxide layer 61 and the layer 62 mainly comprising $SiO_2$ in this order.

The methods for forming the wiring lines and conductive film in the electron source according to the present invention will be then described hereinafter with reference to FIG. 3.

Figure 3A:
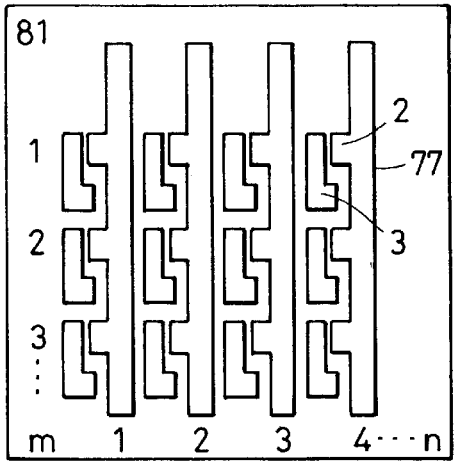
FIG. 3A is an illustrative drawing describing a step for manufacturing the electron source substrate according to the present invention.
Figure 3B:
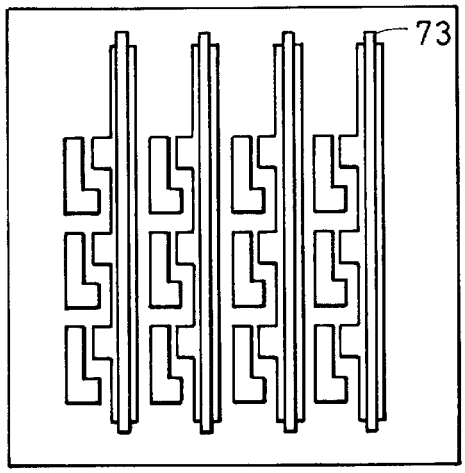
FIG. 3B is an illustrative drawing describing a step for manufacturing the electron source substrate according to the present invention.

As shown in FIG. 3A, $In_2O_3$—$SnO_2$ layer is deposited by the vacuum deposition method or sputtering method at first. Then, n-lines of the third layers 77, and the element electrodes 2 and 3 as a n×m matrix are formed on the surface of the layer 62 mainly comprising $SiO_2$ using a photolithographic method. Then, n-lines of the first wiring lines (Y-direction) 73 are printed with a paste containing Ag particles as shown in FIG. 3B, followed by firing.

Figure 3C:
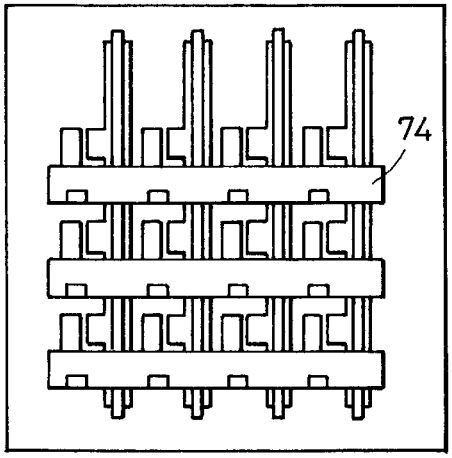
FIG. 3C is an illustrative drawing describing a step for manufacturing the electron source substrate according to the present invention.
Figure 3D:
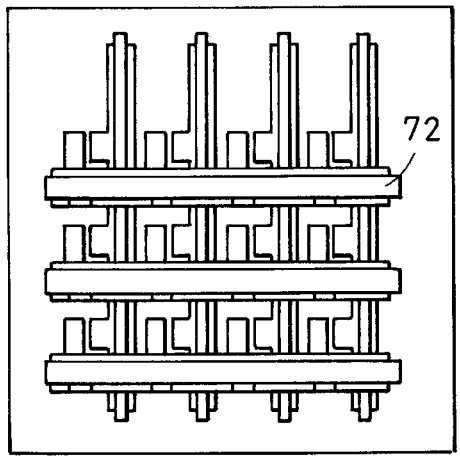
FIG. 3D is an illustrative drawing describing a step for manufacturing the electron source substrate according to the present invention.

In the next step, comb-teeth shaped insulation layers 74 are printed with a paste containing insulation particles (glass particles) as shown in FIG. 3C, followed by firing. Then, a second wiring line (X-direction) 72 is printed with a paste containing Ag on each insulation layer 74 so as to commonly connect the electrodes 3 as shown in FIG. 3D. The first and second wiring lines 72 and 73 are pulled out as external terminals.

Figure 3E:
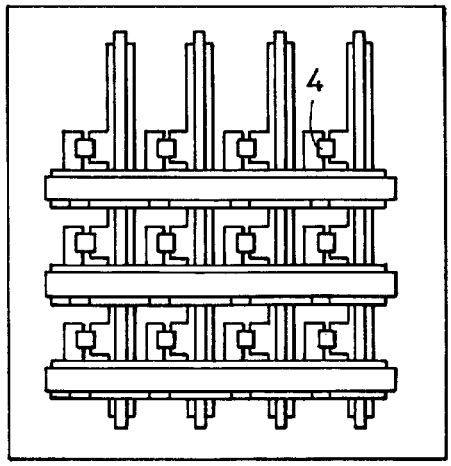
FIG. 3E is an illustrative drawing describing a step for manufacturing the electron source substrate according to the present invention.

Then, as shown in FIG. 3E, a thin film of an organometallic compound is formed by coating a solution of the organometallic compound on the layer 62 mainly comprising $SiO_2$ so as to connect the element electrodes 2 and 3 with each other. An organometallic compound containing the metal in the starting material of the conductive film 4 as a principal element may be used for the solution of the organometallic compound. The thin film of the organometallic compound is heated for firing, and patterned by lift-off or etching to form the conductive film 4. While the method for coating the solution of the organometallic compound was described as an example, the method for forming the conductive film 4 is not necessarily restricted thereto, and a method for coating a dispersion solution, a sputtering method and a dipping method may be used.

The construction of the image display device using the electron source as hitherto described, and examples of the method for manufacturing the same will be described hereinafter.

A scanning signal impression device (not shown) is connected to the second wiring lines 72 shown in FIG. 1 in order to select the columns of the surface conductive elements 76 aligned in the X-direction by the scanning signals. A modulation signal generator (not shown) is connected, on the other hand, to the first wiring lines 73 in order to modulate each row of the surface conduction type electron emission elements 76 aligned in the Y-direction in response to input signals. The addressing voltage to be impressed on each electron emission element is supplied as a differential voltage between the scanning signal and modulation signal impressed on the element. Respective elements can be selected and independently addressed using a passive matrix wiring in the construction as described above.

The construction of the display panel of the image display device having such passive matrix arrangement is approximately the same as the construction shown in the conventional art. The construction will be described with reference to FIG. 8.

Figure 8:
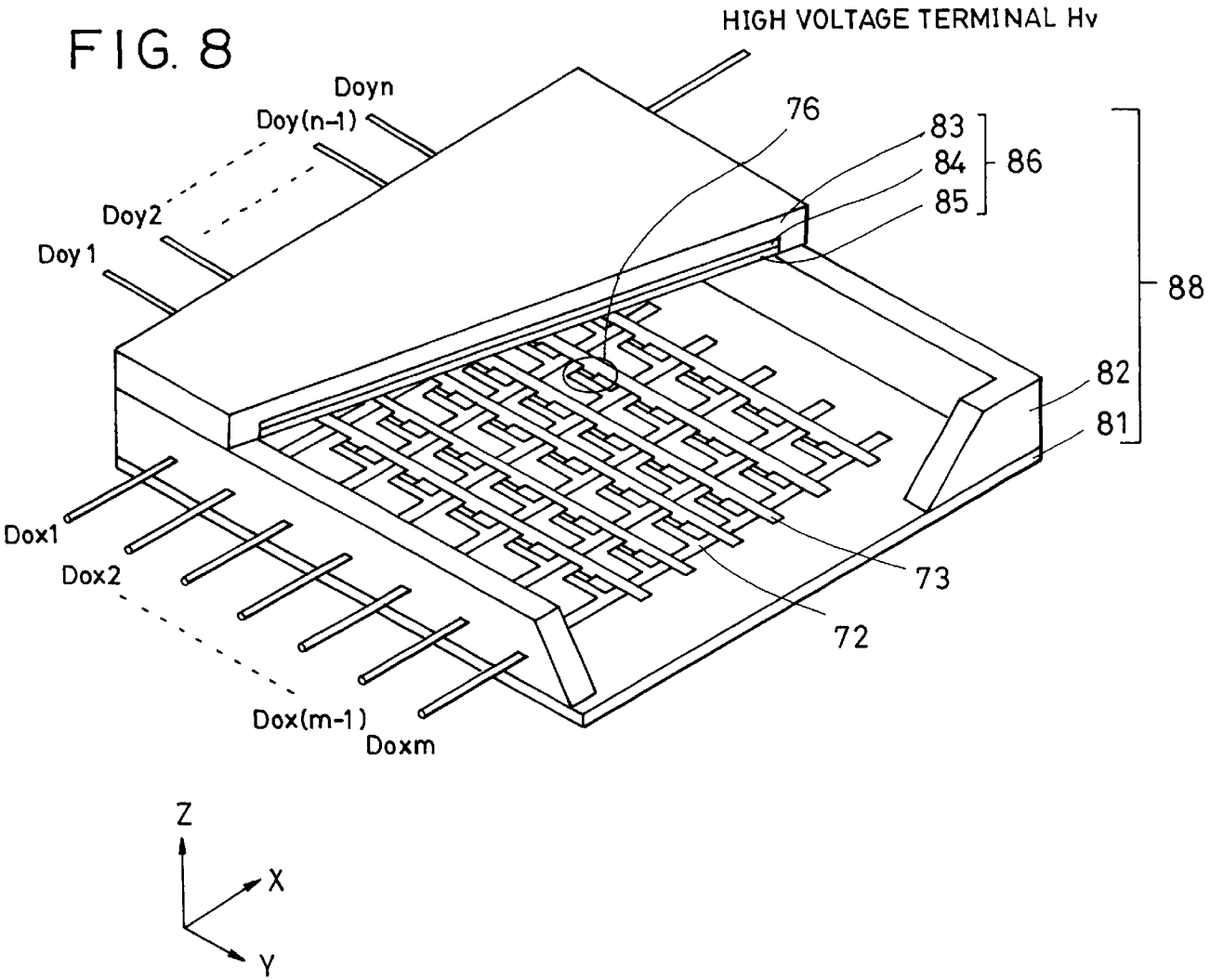
FIG. 8 illustrates the construction of the image display device according to the present invention.

In FIG. 8, the reference numeral 81 denotes an electron source substrate on which plural electron emission elements are aligned, and the reference numeral 86 denotes a face plate in which a fluorescent film 84 and a metal back 85 are formed on the inner face of a glass plate 83. The reference numeral 82 denotes a support frame, and the electron source substrate 81 and face plate 86 are bonded to the support frame 82 using a low melting point frit glass. The reference numerals 72 and 73 denote second and first wiring lines, respectively, connected to a pair of the element electrodes of the surface conduction type electron emission element. An external case 88 is composed of the face plate 86, support frame 82 and electron source substrate 81 as described above. The external case 88 having a sufficient strength against the atmospheric pressure can be manufactured by providing a support member (not shown) called as a spacer between the face plate 86 and electron source substrate 81.

An example of the method for manufacturing the image display device shown in FIG. 8 will be described below. FIG. 9 is an illustrative drawing showing the outline of the apparatus to be used in this manufacturing process. The external case 88 is connected to a vacuum chamber 133 via an evacuation pipe 132, and further connected to an evacuation device 135 via a gate valve 134. A pressure gauge 136 and a quadrupole mass-spectrometer 137 are provided in the vacuum chamber 133 for measuring the inner pressure and partial pressure of each component in the atmosphere. Since it is difficult to directly measure the inner pressure of the external case 88, processing conditions are controlled by measuring the pressure in the vacuum chamber 133. A gas introduction line 138 is connected to the vacuum chamber 133 to control the atmosphere by introducing a required gas into the vacuum chamber. An introduction substance source 140 is connected to the other end of the gas introduction line 138, and the introduction substance is stored in an ampoule or a cylinder. A gas introduction controller 139 for controlling the introduction rate of the introduction substance is provided midway in the gas introduction line. A valve such as a slow leak valve capable of controlling the leak rate and a mass-flow controller are available as the introduction rate control device depending on the kind of the introduction substance.

The inside of the external case 88 is evacuated by the device shown in FIG. 9 for the forming process. In the forming process, for example, the first wiring line 73 is connected to the common electrode 141 as shown in FIG. 11, and a pulse voltage is applied to each element connected to one of the second wiring lines 72 from a power source 142. Processing conditions such as the pulse waveform and decision of the end of the processing may be selected depending on the forming method of each element as described above. It is also possible to simultaneously apply the forming process to the elements connected to plural wiring lines in the X-direction by sequentially applying phase-shift pulses (scroll) to the plural X-lines in the X-direction. The reference numeral 143 denotes an electric current measuring resistor and the reference numeral 144 denotes an oscilloscope for measuring the electric current.

A method for flowing an electric current will be described at first as an example of the forming process. An electron emission part 5 having a modified structure is formed at a site of the conductive film 4 by flowing an electric current between the element electrodes 2 and 3 from the power source 142. A site where the conductive film 4 suffers a structural change such as local destruction, deformation or denaturation is formed by the current flow forming process. The site serves as the electron emission part 5.

Figure 10A:
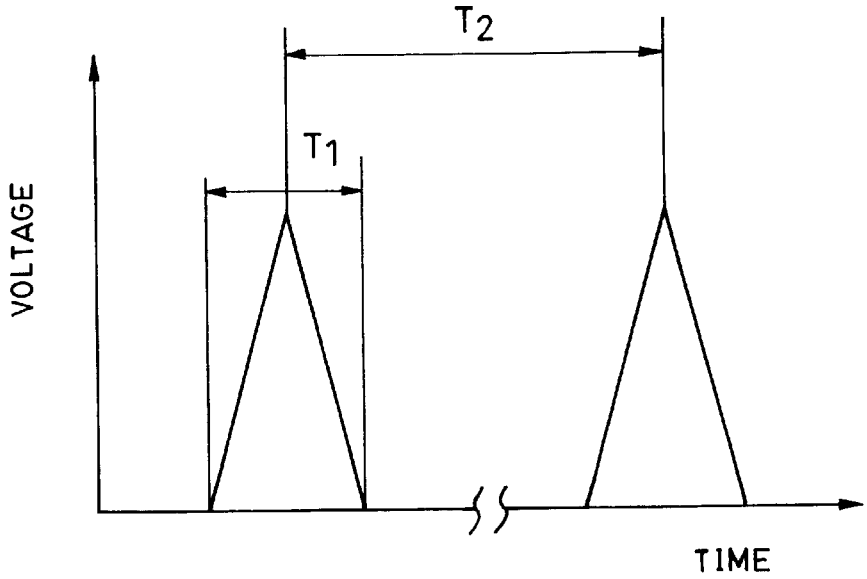
FIG. 10A illustrates the waveform of pulse waves to be used for manufacturing the image display device according to the present invention.
Figure 10B:
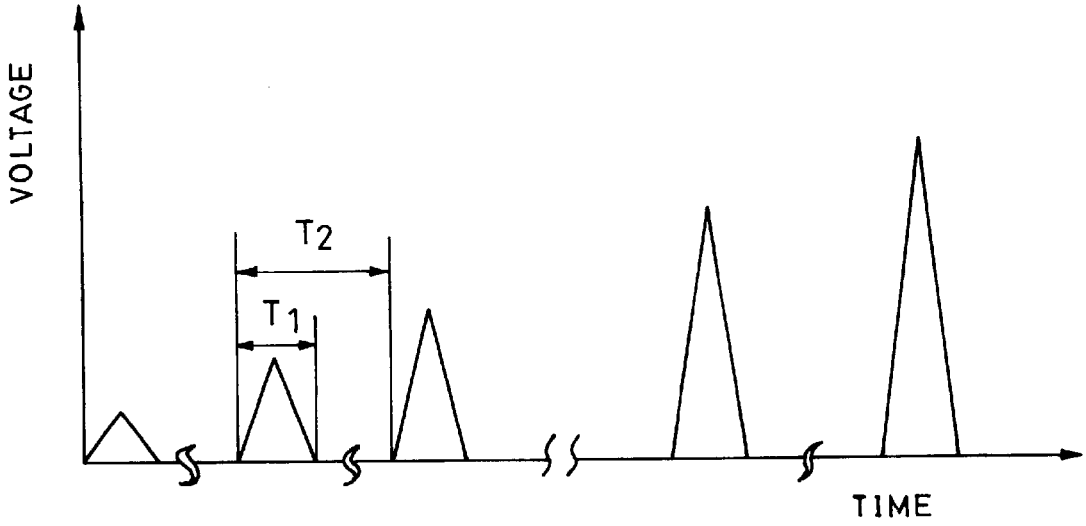
FIG. 10B illustrates the waveform of pulse waves to be used for manufacturing the image display device according to the present invention.

An example of the voltage waveform of the current-flow forming process is shown in FIGS. 10A and 10B. The preferable voltage waveform is a pulse waveform. The methods comprise continuously applying a pulse having a constant voltage of the pulse wave height as shown in FIG. 10A, and applying a voltage pulse with increasing the pulse height as shown in FIG. 10B. T1 and T2 in FIG. 10A denote a pulse width and pulse interval, respectively. Usually, T1 is set in a range of 1 $\mu$sec to 10 msec, and T2 is set in a range of 10 $\mu$sec to 10 msec. The wave height of the triangular wave (peak voltage during the current-flow forming process) is appropriately selected depending on the shape of the surface conduction type electron emission element. The pulse is applied, for example, for several seconds to several tens of minutes under these conditions. The pulse waveform is not necessarily restricted to the triangular wave, and a desired waveform such as a rectangular wave may be used. T1 and T2 in FIG. 10B may be the same as those in FIG. 10A. The wave height (peak voltage during the current-flow forming process) may be increased, for example, by one volt step. The end of the current-flow forming treatment may be sensed by measuring an electric current by applying a voltage in an extent not to locally break or deform the conductive film 4 during the pulse interval T2. For example, a current flowing through the element by applying a voltage of about 0.1V is measured to determine resistance. The current-flow forming process comes to its end when the resistance reaches to 1 MΩ or more.

The element after the forming process is preferably subjected to a treatment called an activation step. The element current If and emission current Ie remarkably changes through this step. The activation step is performed by repeating pulse impression in an atmosphere containing, for example, a gas of an organic substance as in the current-flow forming process. An organic gas remaining in the atmosphere after evacuating the vacuum chamber with an oil diffusion pump or a rotary pump may be used for the activation atmosphere. Otherwise, a gas of an appropriate organic substance may be introduced into a vacuum formed by thoroughly evacuating with an ion pump. The preferable gas pressure of the organic substance may be appropriately determined since it differs depending on the shape of the vacuum chamber or the kind of the organic substance. The appropriate substances include aliphatic hydrocarbons such as alkane, alkene and alkyne, aromatic hydrocarbons, alcohols, aldehydes, ketones, amines, phenols and organic acids such as carboxylic acids and sulfonic acids. Examples of them include saturated hydrocarbons represented by a composition formula of $C_nH_{2n+1}$ such as methane, ethane and propane, unsaturated hydrocarbons represented by a composition formula of $C_nH_{2n}$ such as ethylene and propylene, benzene, toluene, methanol, ethanol, formaldehyde, acetaldehyde, acetone, methylethyl ketone methyl amine, phenol, formic acid, acetic acid and propionic acid.

Carbon or carbon compounds deposit on the element from the organic substance present in the atmosphere by the treatment as described above, thereby allowing the element current If and emission treatment Ie to be remarkably changed. The end of the activation process is appropriately detected from the measurement of the element current If and emission current Ie. The pulse width, pulse interval and pulse wave height are also appropriately determined. The carbon and carbon compounds include, for example, graphite (comprising so-called HOPG and PG and GC; HOPG has an approximately perfect graphite crystal structure, PG has a crystal grain size of about 20 nm with a little distorted crystal structure, and GC has a crystal grain size of about 2 nm with a further distorted crystal structure) and non-crystalline carbon (refers to amorphous carbon and a mixture of amorphous carbon and fine crystals of graphite) having a preferable film thickness in the range of 50 nm or less, more preferably in the range of 30 nm or less.

After thoroughly evacuating the inside of the external case 88, the organic substance is introduced from the gas introduction line 138. Alternatively, the organic substance remaining in the vacuum atmosphere may be used after evacuating with the oil diffusion pump or rotary pump. Substances other than the organic substance may be introduced, if necessary. Carbon or carbon compounds, or a mixture thereof, are deposited on the electron emission part by applying a voltage to each electron emission element in an atmosphere containing the organic substance, thereby drastically increasing the amount of the emitted electrons. A voltage pulse may be simultaneously impressed on the elements connected with the wiring lines in one direction using the same wiring lines as used in the forming process.

A stabilization treatment is preferably applied after completing the activation process. The organic substance in the external case 88 is evacuated in this process. The partial pressure of the organic components in the external case 88 is preferably $3\times10^{-6}$ Pa or less, more preferably $3\times10^{-8}$ Pa or less, where substantially no fresh deposits of carbon and carbon compounds are formed. It is preferable to heat the entire external case 88 to facilitate evacuation of organic molecules absorbed on the inner wall of the external case 88 and on the electron emission elements. The heating condition is 80 to 250° C., preferably 150° C. or more. While a treatment time as long as possible is preferable, the heating conditions are not restricted thereto, but is appropriately selected depending on the conditions such as the size and shape of the vacuum chamber, and construction of the electron emission elements. The pressure in the external case 88 should be as low as possible, preferably $1\times10^{-5}$ Pa and more preferably $1\times10^{-6}$ Pa.

Although the atmosphere during the stabilization treatment is preferably maintained as the atmosphere for addressing the elements after the stabilization treatment, the conditions are not restricted thereto, and sufficiently stable characteristics can be maintained so long as the organic substances are sufficiently removed even when the degree of evacuation is a little deteriorated. Additional deposition of carbon or carbon compounds may be suppressed while enabling $H_2O$ and $O_2$ absorbed on the vacuum chamber and substrate to be removed by using the vacuum atmosphere as described above, thereby stabilizing the element current If and emission current Ie.

After evacuating the chamber to the preferable pressure above, the evacuation pipe is sealed and cut by fusing by heating with a burner. A getter treatment may be applied for maintaining the vacuum of the external case 88 after sealing. In this getter treatment, a getter placed at a predetermined position (not shown) in the external case is heated immediately before or after sealing the external case 88 by heating with resistance heating or microwave heating to from a vacuum deposition film. The getter mainly comprises Ba, and the atmosphere in the external case 88 is maintained by absorption function of the vacuum deposition film.

An example of the construction of an addressing circuit will be described hereinafter with reference to FIG. 12, whereby NTSC type video signals are displayed on a display panel constructed using the passive matrix type electron source. In FIG. 12, the reference numeral 101 denotes an image display panel, the reference numeral 102 denotes a scanning line, the reference numeral 103 denotes a control circuit, and the reference numeral 104 denotes a shift resistor. The reference numeral 105 denotes a line memory, the reference numeral 106 denotes a synchronizing signal separation circuit, and Vx and Va denote direct current voltage sources. The display panel 101 is connected to auxiliary circuits through terminals Dox1 to Doxm, terminals Doy1 to Doyn, and a high voltage terminal Hv. Electron sources provided in the display panel, or a group of the surface conduction type electron emission elements connected to form a M columns and N rows matrix, are sequentially addressed one by one by impressing scanning signals on the terminals Dox1 to Doxm for the columns (N columns). Modulation signals for controlling an output electron beam from each element of the surface conduction type electron emission elements on one column selected by the scanning signal are impressed on the terminals Doy1 to Doyn. While a direct current voltage of the magnitude of 10 kV is supplied to the high voltage terminal Hv from the direct current voltage source Va, this voltage serves as an acceleration voltage for endowing the electron beam emitted from the surface conduction type electron emission element with a high energy sufficient for exciting the fluorescent material.

The scanning circuit 102 will be described below. The circuit comprises M switching elements (illustrated by S1 to Sm in the drawing) in it. Each switching element selects either the output voltage of the direct current source Vx or zero voltage (ground level), and is electrically connected to one of the terminals Dox1 to Doxm of the display panel 101. Each switching element of S1 to Sm operates based on the control signal $T_{scan}$ supplied from the control circuit 103, and is constructed by a combination of switching elements such as FET.

The direct current voltage Vx is set so as to output a constant voltage so that the addressing voltage impressed on the elements before scanning becomes lower than a threshold level voltage based on the characteristics (electron emission threshold level voltage) of the surface emission type electron emission element in this embodiment. The control circuit 103 has a function for allowing the action of each part to match so as to enable an appropriate display based on the input image signals. The control circuit 103 generates control signals of $T_{scan}$, $T_{sft}$ and $T_{mry}$ to each part based on the synchronizing signal $T_{sync}$ transferred from the synchronizing signal separation circuit 106. The synchronizing signal separation circuit 106 serves for separating synchronizing signal components and luminance signal components from NTCS type video signals imported from the outside, and is constructed using general purpose frequency separation (filter) circuits. While the synchronizing signals separated by the synchronizing signal separation circuit 106 comprise a vertical synchronizing signal and horizontal synchronizing signal, the signal was shown as the $T_{sync}$ signal in the drawing in this embodiment for the convenience of explanation. The luminance signal components separated from the video signal were also optionally denoted as DATA signals. The data signal is transferred to the shift resistor 104.

The shift resistor 104 serves for serial/parallel conversion of the DATA signals serially imported as time series signals for every line of the image, and is operated based on the control signal $T_{sft}$ transferred from the control circuit 103 (the control signal $T_{sft}$ may serve as a shift-clock of the shift resistor 104). The data for one line of the image after the serial/parallel conversion (corresponds to the addressing signal to N pieces of the electron emission elements) are transferred from the shift resistor 104 as N units of the parallel signals of Id1 to Idn. The line memory 105 is a memory device for storing one line of the image data for a required time period, and appropriately stores the contents of Id1 to Idn according to the control signal transferred from the control circuit 103. The contents of the memory are transferred as I'd1 to I'dn, and imported into the modulation signal generator 107. The modulation signal generator 107 is a signal source for appropriately modulating addressing of each surface conduction type electron emission element in response to the image signals I'd1 to I'dn, and the output signal is impressed on each surface conduction type electron emission element in the panel 101 through the terminals Doy1 to Doyn.

The surface conduction type electron emission element described above has the following basic characteristics against the emission current Ie. Since a distinct threshold voltage $V_{th}$ exists for electron emission, the electrons are emitted only when a voltage larger than $V_{th}$ is applied. The emission current also changes depending on the applied voltage change to the element at a voltage larger than the threshold level for electron emission. This means that, although electron emission does not occur by applying a voltage lower than the threshold level for electron emission, an electron beam is emitted by applying a voltage higher than the threshold level for electron emission. It is then possible to control the intensity of the emitted electron beam by changing the pulse wave height Vm. It is also possible to control the total charge of the emitted electron beam by changing the pulse width Pw. Accordingly, the method for modulating the electron emission element depending on the input signal comprises a voltage modulation method and a pulse width modulation method. When the voltage modulation method is employed, a given length of pule voltage is generated from the modulation signal generator 107, and a voltage modulation circuit that can appropriately modulate the pulse wave height in accordance with the input data may be used.

A given wave height of voltage pulses are generated from the modulation signal generator 107, and a pulse width modulation circuit that can appropriately modulate the voltage pulse width in accordance with the input data may be used for applying the pulse modulation method.

The shift resistor 104 and line memory 105 may be operated by either a digital signal method or an analog signal method, since serial/parallel conversion and storage of the image signal may be performed at a given speed.

An A/D converter may be provided at the output terminal of the synchronizing signal separation circuit 106 when the output signal DATA of the synchronizing signal separation circuit 106 should be converted into digital data for applying the digital signal method. In relation to A/D conversion as described above, the circuit to be used for the modulation signal generator 107 turns put to be a little different depending on either the output signal is a digital signal or an analog signal. For example, a D/A conversion circuit is used for the modulation signal generator 107 in the voltage modulation method using digital signals, and an amplification circuit is added if necessary. A combined circuit of, for example, a high speed oscillator, a counter for counting the wave number of the oscillator output and a comparator for comparing the counter output level with the memory output level is used for the modulation signal generator 107 in the pulse width modulation method. An amplifier may be added, if necessary, whereby the voltage of the pulse width modulation signal as the output of the comparator is amplified up to the addressing voltage of the surface conduction type electron emission element.

In the case of the voltage modulation method using the analog signals, an amplifier circuit using, for example, an operational amplifier can be used, and a level shift circuit is added to the amplifier, if necessary. In the case of the pulse width modulation method, a voltage control type oscillator circuit (VOC) can be used for example, and an amplifier for amplifying the voltage up to the addressing voltage of the surface conduction type electron emission element may be added to the amplifier, if necessary. Electrons are emitted by impressing a voltage on each electron emission element through the external terminals Dox1 to Doxm, and Doy1 to Doym of the case in the image display device according to the present invention so configured as described above. The electron beam is accelerated by impressing a high voltage on the metal back 85 or transparent electrodes (not sjpwn) through the high voltage terminal Hv. The accelerated electrons collides with the fluorescent film 84 to emit a light forming an image.

The construction of the image display device as hitherto described is only one example of the image display device to which the present invention is applicable, and various modifications are possible based on the technical concept of the present invention. While the NTSC method was exemplified as a signal input method, it is not necessarily restricted to the NTSC method, and TB signals comprising a number of scanning lines (high quality TV signals by, for example, a MUSE method) may be employed in addition to PAL and SECAM methods.

EXAMPLES

While the present invention will be described in detail hereinafter with reference to embodiments, the present invention is by no means restricted to these examples. The present invention encompasses those in which each element is substituted or its design is modified within the scope for attaining the object of the present invention.

The electron source substrate 81 was manufactured in this embodiment following the manufacturing steps shown in FIGS. 3A to 3E, and the external case 88 was manufactured as described in the embodiment.

The electron source substrate shown in FIG. 1 is manufactured as follows:

(Step 1)

The blue sheet glass ($SiO_2$: 74%, $Na_2O$: 12%, CaO: 9%, $K_2O$: 3%, MgO: 2%) as the substrate 6 was thoroughly cleaned, and the conductive oxide layer 61 containing $SiO_2$ and mainly comprising $SnO_2$ was formed by sputtering. The thickness of the conductive oxide layer 61 was about 300 nm.

(Step 2)

Then, a layer 62 mainly comprising $SiO_2$ was formed by the CVD method. The material source used was TEOS [tetraethoxy silica; $Si(OC_2H_5)_4$]. The layer 62 mainly comprising $SiO_2$ was formed to have a thickness of about 100 nm.

(Step 3)

A pair of the element electrodes 2 and 3 of the surface conduction type electron emission element, and the third layer 77 were formed were formed on the electron source substrate 81 manufactured in the steps 1 and 2.

At first, $In_2O_3$—$SnO_2$ with a thickness of 100 nm was deposited by sputtering on the electron source substrate 81 manufactured in the steps 1 and 2. Then, a pair of the element electrodes 2 and 3, and the third layer 77 were formed by photolithography into a pattern shown in FIG. 3A. The width W2 (FIG. 1) of the third layer 77 was 120 $\mu$m, which was wider than the width W1 (FIG. 1) of the first wiring line of 100 $\mu$m (Example 1).

The width W2 of the third layer 77 was 80 $\mu$m, which was narrower than the width W1 of the first wiring line 73 of 100 $\mu$m (Example 2). The excess portion of the first wiring line was exposed at both sides of the third layer by a length of 10 $\mu$m in this pattern (Example 2).

An electron source substrate 81 using conventional element electrodes was also manufactured by the step 3' as shown below (Comparative Example). The step 4 and the steps thereafter were the same as described in Examples 1 and 2).

(Step 3')

A pattern with the shapes of the element electrodes 2 and 3 were formed on the electron source substrate 81 manufactured in the steps 1 and 2 by offset printing using a platinum reginate paste (made by N. E. Chemcat Co.).

After offset printing, the pattern was dried at 80° C. for 20 minutes, and the paste was fired under the conditions of a peak temperature of 520° C. and holding time of 8 minutes using a heat-treatment apparatus to form the element electrodes 2 and 3 with a thickness of 40 nm. The space between the element electrode was 20 $\mu$m.

(Step 4)

A pattern of the first wiring lines 73 was formed by screen printing using a paste material containing silver as a metallic component (NP-4028A, made by Noritake Co.), and the pattern as fired under the same condition as used in the step 3 to form the first wiring lines 73 (FIG. 3B). The width of the wiring line was 100 $\mu$m.

(Step 5)

A pattern of the insulation layers 74 was printed using a paste mainly comprising PbO and the pattern was fired under the same condition as in the step 3 to form the insulation layers 74 (FIG. 3C). The insulation layer 74 has a cut-off portion so that the element electrode 3 is electrically connected to the second wiring line 72 to be formed in the steps hereinafter.

(Step 6)

The second wiring lines 72 were formed by the same method as in the step 4 (FIG. 3D), forming a matrix of wiring lines comprising plural first and second wiring lines 73 and 72.

(Step 7)

Then, the conductive film 4 was formed between a pair of the element electrodes 2 and 3. A solution containing an organic palladium was applied with a thickness of 100 $\mu$m using an ink jet spray apparatus by a bubble jet method. The conductive film 4 comprising fine particles of palladium oxide was obtained after a heat-treatment at 350° C. for 10 minutes (FIG. 3E).

(Step 8)

The electron source substrate 81 manufactured in the steps 1 to 7 was assembled with the face plate 86 (having the fluorescent film 84, metal back 85 on the inner surface of the glass substrate 83) and support frame 82, and the assembly was sealed. The distance between the electron source substrate 81 and the face plate 86 was 2 mm. A getter (not shown) for microwave heating was provided in the external case 88, and an evacuation pipe (not shown) for controlling the atmosphere in the external case 88 was attached in the external case 88. The assembly was fused by heat-treating at 450° C. for 10 minutes after coating a frit glass on the portions to be fused.

(Step 9)

The inside of the external case 88 was evacuated through the evacuation pipe (not shown) using an evacuation device (using an oil diffusion pump as a main pump) to reduce the pressure to $1.3\times10^{-3}$ Pa. Then, a forming treatment was applied by repeatedly impressing pulse voltages between plural pairs of the element electrodes 2 and 3 through the first and second wiring lines 72 and 73. The pulses shown in FIG. 10B were used for the forming treatment, and a gap 5 shown in FIG. 2 was formed on each of the plural conductive films 4 with pulse intervals of T1=1 msec an T2=10 msec. This treatment was applied for every wiring line of the elements connected to each of the second wiring lines 72. Treatment of one wiring line was completed when the resistance of the wiring line had exceeded 1 MΩ, and the treatment was shifted to the next wiring line. This process was repeated for the treatment of all the elements.

(Step 10)

Subsequently, an activation treatment was applied. As has been explained in the embodiment, the procedures of introducing an acetone vapor into the external case 88 through the gas introduction line 138, adjusting the pressure at $7\times10^{-1}$ Pa, and sequentially impressing a rectangular pulse with a wave height of 18V were repeated in the activation step. Then, the evacuation device was switched to a device using a magnetic levitation type turbo pump as a main pump, and the stabilization treatment was performed by evacuating the inside of the external case 88 while heating the entire external case 88 at 200° C. After a getter treatment by microwave heating, the evacuation pipe was cut-off by heating and fusing.

After completing the steps 1 to 10, the time dependent changes of the element current If and emission current Ie were measured by applying a rectangular pulse to every element in the external case 88 for 50 hours, and the measured values were compared with the measured values with respect to arbitrary elements 10 in the external case 88 in Comparative Example. The wave height was 18V, the pulse width was 1 msec, the pulse interval was 10 msec, and the potential of the metal back 85 was 1 kV.

Figure 6A:
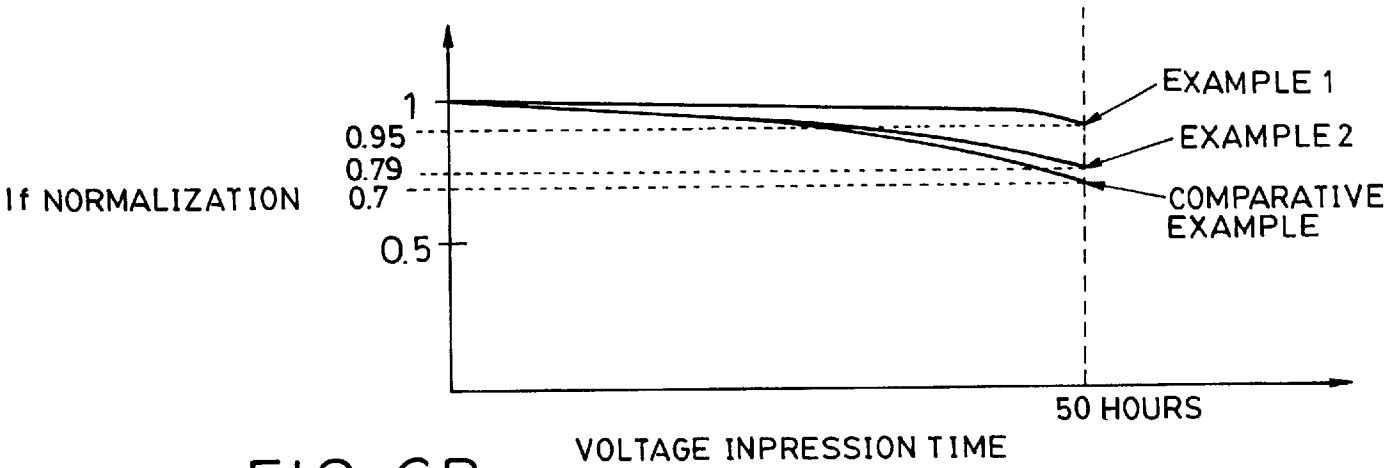
FIG. 6A shows the graphs indicating time-dependent changes of the electron emission characteristics (If, Ie) in Examples 1 and 2, and in Comparative Examples according to the present invention.
Figure 6B:
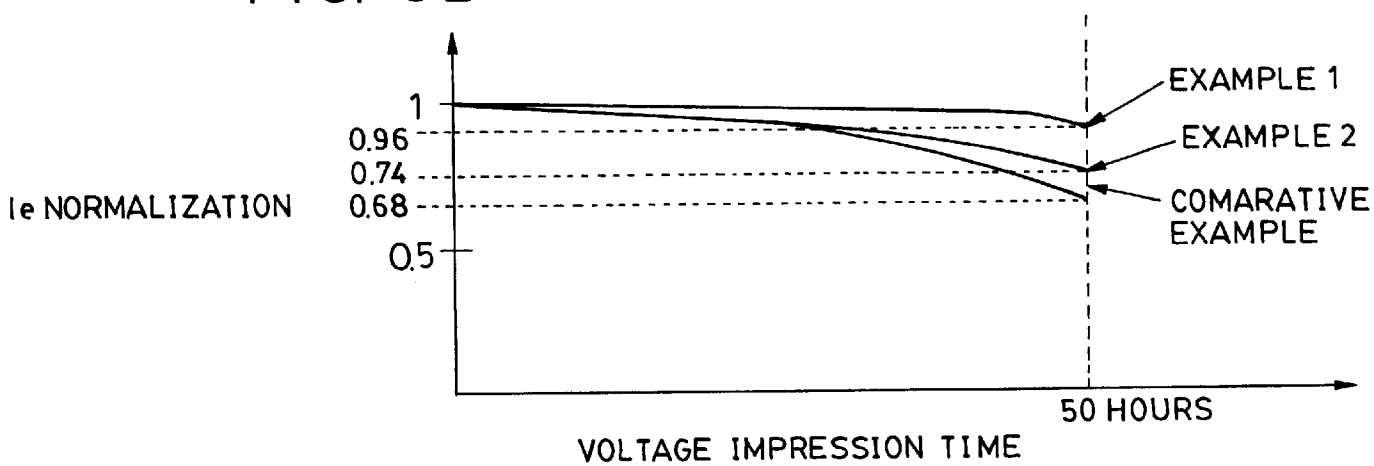
FIG. 6B shows the graphs indicating time-dependent changes of the electron emission characteristics (If, Ie) in Examples 1 and 2, and in Comparative Examples according to the present invention.

FIGS. 6A and 6B show the graphs showing the time dependent changes of the element current If and emission current Ie (graphs with respect to the elements 1 and 2 in Example 1, and one element representing each element in the Comparative Example). FIGS. 6A and 6B show that deterioration of the electron sources (time-dependent decrease of If and Ie) is largely improved in Example 1 as compared with those in the Comparative Example. The effect of the third layer is not so strongly exhibited in Example 2, and deterioration of the electron source is not so much improved.

Table 1 shows the ranges of the rate of changes of the element current and emission current in Examples 1 and 2, and those of 10 elements in the Comparative example. The rate of change of the element current and emission current are expressed as follows;

Rate of change of element current=[(maximum If−minimum .If)/mean value of If]×100 8%)

Rate of change of emission current=[(maximum Ie−minimum Ie)/mean value of If]×100 8%)

TABLE 1

Figure 7A:
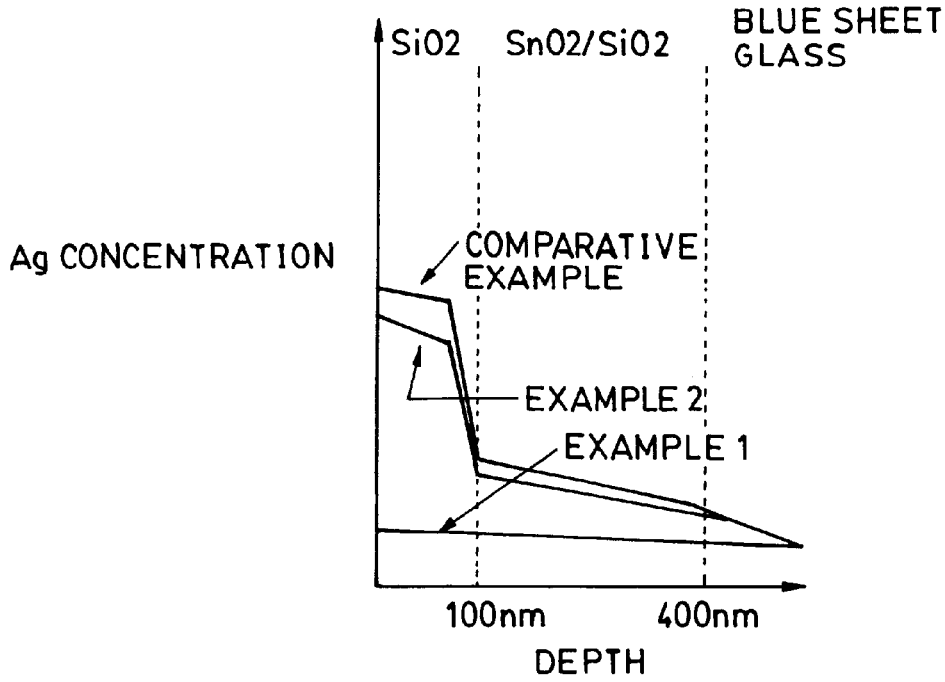
FIG. 7A shows the graphs indicating the results of SIMS analysis of the electron emission sites in Examples 1 and 2, and in Comparative Examples according to the present invention.
Figure 7B:
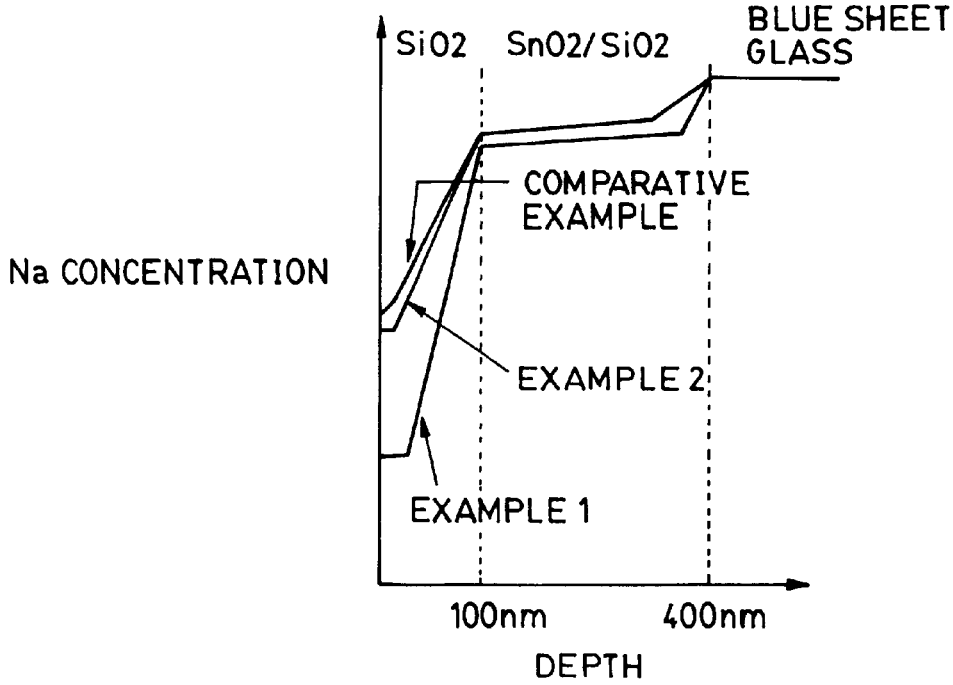
FIG. 7B shows the graphs indicating the results of SIMS analysis of the electron emission sites in Examples 1 and 2, and in Comparative Examples according to the present invention.

The external case 88 was disassembled after the measurement, and the electron emission part (the gap 5) of each of the evaluated electron emission element was analyzed along the depth direction by SIMS analysis (Secondary Ion Mass-spectrometric analysis). The results are shown in FIG. 7. The uppermost surface of the $SiO_2$ layer contained a larger amount of Ag ions in Example 2 and Comparative example than in Example 1. Na ions are also contained in a larger amount in Example 2 and Comparative Example than in Example 1 due to the presence of the Ag ions. The results in Table 1 may be elucidated by the presence or absence of the Na ions.

The results in FIGS. 6 and 7 and in Table 1 show that the electron source is less deteriorated (smaller rate of changes of the element current and emission current) in Example 1 than in the Comparative Example, showing better stability in Example 1. In other words, diffusion of Ag is suppressed to consequently suppress diffusion of Na, thereby greatly reducing deterioration of the electron source, by disposing the third layer ($In_2O_3$—$SnO_2$) between the electron source substrate 81 and first wiring lines. The electron source in Example 1 is also less deteriorated (smaller rate of changes of the element current and emission current) as compared with the electron source in Example 2, exhibiting better stability. Consequently, it is preferable that the third layer has a wider width than the first layer (W1<W2).

As is made clear in the foregoing description, the metal ions (Ag ions and the like) contained in the wiring lines are prevented from diffusing by the bonding temperature of the glass frit, by providing the conductive member ($In_2O_3$—$SnO_2$ and the like) for blocking transfer of the metals contained in the wiring lines to the conductive film in the electron source using Ag in the material for the matrix of the wiring lines. Consequently, the Na ions in the substrate are suppressed from diffusing to the electron emission part to prevent deterioration of the electron source. As a result, a luminous and high quality image display device can be provided.

The element electrodes can be manufactured with a low manufacturing cost than using expensive Pt element electrodes, when the element electrodes are formed by the conductive member for blocking the metals contained in the wiring lines from transferring to the conductive film, and the element electrodes are formed in the same step as forming the wiring lines.

The present invention as hitherto described provides a luminous and high quality image display device in the electron source by preventing metallic ions from diffusing from the wiring lines by the bonding temperature of the glass frit for evacuating the image display device, or by the heat generated in addressing the image display device.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structured and functions.

What is claimed is:

1. An electron source, comprising:

a substrate;

an antistatic film formed on said substrate;

a plurality of electron emission elements disposed on said antistatic film, and wiring lines containing a metal for connecting said plurality of electron emission elements, said wiring lines including a plurality of first wiring lines intersecting with a plurality of second wiring lines, with an insulation layer disposed between said first and second lines, wherein each said electron emission element comprises a conductive film including an electron emission part disposed on said antistatic film, with said conductive film electrically connected to said wiring lines via a conductive member provided between said wiring lines and said antistatic film and containing materials with a function of blocking metal ions contained in said wiring lines from being transferred to the conductive film, said conductive member extending beneath and along said first wiring lines and between said first wiring lines and said antistatic film.

2. An electron source, comprising:

a substrate containing sodium;

a sodium blocking film formed on said substrate;

a plurality of electron emission elements disposed on said sodium blocking film; and wiring lines containing a metal for connecting said plurality of electron emission elements, said wiring lines including a plurality of first wiring lines intersecting with a plurality of second wiring lines, with an insulation layer disposed between said first and second lines, wherein said electron emission element comprises a conductive film including an electron emission part disposed on said sodium blocking film, said conductive film electrically connected to said wiring lines via a conductive member provided between said wiring lines and said sodium blocking film and containing materials with a function of blocking metal ions contained in said wiring lines from being transferred to said conductive film, said conductive member extending beneath and along said first wiring lines and between said first wiring lines and said sodium blocking film.

3. An electron source, comprising:

a substrate;

a film of an insulation material provided on said substrate and containing a metal oxide;

a plurality of electron emission elements disposed on said film; and wiring lines containing a metal for connecting said plurality of electron emission elements, said wiring lines including a plurality of first wiring lines intersecting with a plurality of second wiring lines, with an insulation layer disposed between said first and second lines, wherein said electron emission element comprises a conductive film including an electron emission part disposed on said film, said conductive film being electrically connected to said wiring lines via a conductive member containing materials with a function of blocking metal ions contained in said wiring lines from being transferred to said conductive film provided between said film and said wiring lines, said conductive member extending beneath and along said first wiring lines and between said first wiring lines and said film of an insulation material.

4. An electron source, comprising:

a substrate;

a $SiO_2$ film provided on said substrate and containing a metal oxide;

a plurality of electron emission elements disposed on said $SiO_2$ film containing the metal oxide; and wiring lines for connecting said plurality of electron emission elements, said wiring lines including a plurality of first wiring lines intersecting with a plurality of second wiring lines, with an insulation layer disposed between said first and second lines, wherein each said electron emission element comprises a conductive film containing an electron emission part disposed on said $SiO_2$ film, said conductive film being electrically connected to said wiring lines via a member comprising $In_2O_3$—$SnO_2$ provided between said $SiO_2$ film and said wiring lines, said member comprising $In_2O_3$—$SnO_2$ extending beneath and along said first wiring lines and between said first wiring lines and said $SiO_2$ film.

5. An electron source according to of claim 3 or 4, wherein said metal oxide is an electron conductive oxide.

6. An electron source according to claim 3 or 4, wherein said metal oxide is an oxide of a metal selected from Fe, Ni, Cu, Pd, Ir, In, Sn, Sb and Re.

7. An electron source according to claim 3 or 4, wherein a film comprising $SiO_2$ is further laminated on said $SiO_2$ film.

8. An image display device, comprising:

an electron source comprised of:

a substrate;

a film formed on said substrate;

a plurality of electron emission elements disposed on said film; and wiring lines containing a metal for connecting said plurality of electron emission elements, said wiring lines including a plurality of first wiring lines intersecting with a plurality of second wiring lines, with an insulation layer disposed between said first and second lines, wherein each said electron emission element comprises a conductive film including an electron emission part disposed on said film, with said conductive film electrically connected to said wiring lines via a conductive member provided between said wiring lines and said film containing materials and with a function of blocking metal ions contained in said wiring lines from being transferred to said conductive film, said conductive member extending beneath and along said first wiring lines and between said first wiring lines and said film; and an image display member for displaying an image by electron irradiation from said electron source.

9. An image display device according to claim 8, wherein said film is an antistatic film.

10. An image display device according to claim 8, wherein said substrate contains sodium, and said film is a sodium blocking film.

11. An image display device according to claim 8, wherein said film is an insulation material and contains a metal oxide.

12. An image display device according to claim 8, wherein said film is a $SiO_2$ film and contains a metal oxide.

* * * * *

UNITED STATES PATENT AND TRADEMARK OFFICE

CERTIFICATE OF CORRECTION

PATENT NO. : 6,762,542 B2
DATED : July 13, 2004
INVENTOR(S) : Kouki Nukanobu et al.

It is certified that error appears in the above-identified patent and that said Letters Patent is hereby corrected as shown below:

Drawings,
Sheet 5, FIG. 6A, “INPRESSION” should read -- IMPRESSION --.
Sheet 5, FIG. 6B, “COMARITIVE” should read -- COMPARITIVE --.
Sheet 8, FIG. 9, “AMPUULE” should read -- AMPOOLE --.

Column 2,
Line 32, “fluorescence” (both occurrences) should read -- fluorescent --.
Line 38, “hundreds” should read -- hundred --.
Line 39, “hundreds” should read -- hundred --.

Column 3,
Line 14, “25” should be deleted.

Column 6,
Line 27, “featured” should read -- features --.

Column 12,
Line 21, “from” should read -- form --.

Column 14,
Line 48, “with” should read -- while --.

Column 16,
Line 31, “from” should read -- form --.

Column 18,
Line 8, “pule” should read -- pulse --.
Line 28, “put” should read -- out --.
Line 29, “on” should read -- on if --.
Line 57, “(not sjpwn)” should read -- (not shown) --.

Column 19,
Line 34, “were formed” (first occurrence) should be deleted.

Column 21,
Line 28, “Rate of change of element current=[(maximum If-minimum .IF)/” should read -- Rate of change of element current=[(maximum If-minimum If)/ --.

UNITED STATES PATENT AND TRADEMARK OFFICE

CERTIFICATE OF CORRECTION

PATENT NO. : 6,762,542 B2
DATED : July 13, 2004
INVENTOR(S) : Kouki Nukanobu et al.

It is certified that error appears in the above-identified patent and that said Letters Patent is hereby corrected as shown below:

Column 22,
Line 27, "structured" should read -- structures --.

Column 24,
Line 4, "of" should be deleted.

Signed and Sealed this

Twenty-eighth Day of December, 2004

JON W. DUDAS
*Director of the United States Patent and Trademark Office*